US008437680B2

(12) United States Patent
Kim et al.

(10) Patent No.: US 8,437,680 B2
(45) Date of Patent: May 7, 2013

(54) DEVELOPER AND IMAGE FORMING APPARATUS INCLUDING THE SAME

(75) Inventors: Jong-in Kim, Suwon-si (KR); Dae-seob Kwon, Suwon-si (KR); Sang-hoon Lee, Suwon-si (KR)

(73) Assignee: Samsung Electronics Co,. Ltd, Suwon-si (KR)

( * ) Notice: Subject to any disclaimer, the term of this patent is extended or adjusted under 35 U.S.C. 154(b) by 302 days.

(21) Appl. No.: 12/872,088

(22) Filed: Aug. 31, 2010

(65) Prior Publication Data

US 2011/0182639 A1 Jul. 28, 2011

(30) Foreign Application Priority Data

Jan. 25, 2010 (KR) ..... 10-2010-0006500

(51) Int. Cl.
*G03G 21/00* (2006.01)
*G03G 21/12* (2006.01)

(52) U.S. Cl.
USPC ..... 399/358; 399/360

(58) Field of Classification Search ..... 399/358, 399/360
See application file for complete search history.

(56) References Cited

U.S. PATENT DOCUMENTS

| | | | | |
|---|---|---|---|---|
| 4,685,798 | A * | 8/1987 | Matsumoto | 399/358 |
| 6,622,001 | B2 * | 9/2003 | Arimitsu et al. | 399/358 |
| 7,016,639 | B2 | 3/2006 | Park et al. | |
| 7,415,237 | B2 | 8/2008 | Okoshi | |
| 7,596,337 | B2 * | 9/2009 | Sato | 399/101 |
| 2003/0161644 | A1 | 8/2003 | Yokoi et al. | |
| 2004/0114959 | A1 | 6/2004 | Daniels | |
| 2004/0258441 | A1 * | 12/2004 | Park et al. | 399/350 |
| 2006/0159497 | A1 * | 7/2006 | Choi et al. | 399/358 |
| 2006/0216083 | A1 * | 9/2006 | Okoshi | 399/350 |
| 2007/0110458 | A1 * | 5/2007 | Inoue et al. | 399/35 |
| 2008/0226367 | A1 | 9/2008 | Kim et al. | |
| 2009/0087214 | A1 | 4/2009 | Utsunomiya et al. | |
| 2009/0214254 | A1 | 8/2009 | Jeon | |
| 2009/0222664 | A1 | 9/2009 | Cho et al. | |

FOREIGN PATENT DOCUMENTS

| | | | |
|---|---|---|---|
| JP | 9-106162 | | 4/1997 |
| JP | 10-301460 | | 11/1998 |
| JP | 10301380 | A * | 11/1998 |
| JP | 10301460 | A * | 11/1998 |
| JP | 11-002947 | | 1/1999 |
| JP | 11002947 | A * | 1/1999 |
| JP | 2002-341648 | | 11/2002 |

(Continued)

OTHER PUBLICATIONS

Korean Office Action issued Aug. 26, 2011 in KR Application No. 10-2010-0070473.

(Continued)

*Primary Examiner* — David Gray
*Assistant Examiner* — Tyler Hardman
(74) *Attorney, Agent, or Firm* — Stanzione & Kim, LLP

(57) ABSTRACT

A developer includes a waste toner container having a cleaning member to clean a photoconductive drum, and a waste toner transporting member to transport waste toner from the photoconductive drum to a waste toner storage area. The waste toner transporting member is moved up, down, forward, and backward by a rotation member having an eccentricity unit. As the rotation member rotates, the waste toner transporting member, which is connected to the eccentricity unit, moves up, down, forward, and backward.

28 Claims, 20 Drawing Sheets

FOREIGN PATENT DOCUMENTS

| | | | | |
|---|---|---|---|---|
| JP | 2011149981 | A | * | 8/2011 |
| KR | 1020040110339 | | | 12/2004 |
| KR | 10-0518822 | | | 10/2005 |
| KR | 1020060081453 | | | 7/2006 |
| KR | 10-0682812 | | | 2/2007 |
| KR | 1020070097994 | | | 10/2007 |

OTHER PUBLICATIONS

European Search Report issued Dec. 2, 2010 in EP Application No. 10176482.7.
Extended European Search Report issued Aug. 4, 2011 in EP Application No. 10175192.3.
European Search Report issued May 13, 2011 in EP Application No. 10176482.7.
Partial European Search Report issued May 20, 2011 in EP Application No. 10175192.3.
Extended European Search Report issued May 24, 2011 in EP Application No. 10175135.2.
Korean Notice of Allowance Issued on Sep. 27, 2012 in KR Patent Application No. 10-2011-0109436.

* cited by examiner

DEVELOPER AND IMAGE FORMING APPARATUS INCLUDING THE SAME

CROSS-REFERENCE TO RELATED APPLICATIONS

This application claims the benefit of Korean Patent Application No. 10-2010-0006500, filed on Jan. 25, 2010, in the Korean Intellectual Property Office, the disclosure of which is incorporated herein in its entirety by reference.

BACKGROUND

1. Field of the Invention

The present general inventive concept relates to a developer including a waste toner container to store waste toner removed from a photoconductor and an image forming apparatus including the developer.

2. Description of the Related Art

Electrophotographic image forming apparatuses radiate light modulated according to image information onto a photoconductor, form an electrostatic latent image on the surface of the photoconductor, apply toner to the electrostatic latent image so as to develop as a visible toner image, transfer and fix the toner image to a recording medium, and print an image to a recording medium. Before a next image is printed, toner and foreign bodies remaining on the photoconductor are removed from the photoconductor.

The photoconductor and toner may be provided together in a cartridge that is referred to as a 'developer.' The developer includes a waste toner container to store waste toner removed from the photoconductor.

SUMMARY

Waste toner removed from a photoconductor is stored in a waste toner container to prevent toner from leaking out of the developer and contaminating the image forming apparatus.

The present general inventive concept provides a developer having an improved structure including a container to store waste toner removed from a photoconductor and an image forming apparatus including the developer.

Additional aspects and utilities of the present general inventive concept will be set forth in part in the description which follows and, in part, will be obvious from the description, or may be learned by practice of the present general inventive concept.

Features and/or utilities of the present general inventive concept may be realized by a developer comprising a photoconductor and a cleaning member that removes waste toner from the photoconductor after image development. The developer may include a waste toner container comprising a cleaning unit in which the photoconductor and the cleaning member are installed, and a container spaced apart from the cleaning unit, a rotation member installed in the container and comprising an eccentricity unit, a support unit of which at least a part thereof is inclined upward toward the container from the cleaning unit, and a waste toner transporting member comprising a support protrusion that contacts the support unit by sliding, is installed in the waste toner container, and transports the waste toner to the container from the cleaning unit. An end part of the waste toner transporting member is combined with the eccentricity unit and moves back and forth and upward and downward due to a rotation of the rotation member.

The waste toner transporting member may include a plurality of horizontal ribs that are spaced apart from each other in a direction of the back-and-forth movement and a plurality of spaces for transporting the waste toner is formed between the plurality of horizontal ribs.

The plurality of horizontal ribs may have the same thickness in the direction of the back-and-forth movement, the plurality of spaces may have the same width in the direction of the back-and-forth movement, and a stroke length in a direction of the back-and-forth movement of the waste toner transporting member may be at least larger than the sum of the thickness and the width.

The widths of the spaces gradually may decrease from the cleaning unit toward the container. Intervals between the plurality of horizontal ribs in the direction the back-and-forth movement may be the same as each other and the thickness of the plurality of horizontal ribs in the direction of the back-and-forth movement gradually may increase from the cleaning unit to the container. The stroke length of the waste toner transporting member in the direction of the back-and-forth movement may be at least larger than the intervals between the plurality of horizontal ribs in the direction of the back-and-forth movement.

Chamfered portions may be formed at edges of the plurality of horizontal ribs facing the cleaning unit.

The developer may further include an upper frame constituting an upper wall of the waste toner container, wherein a recessed portion depressed downwardly is provided in a center portion of the upper frame.

Both side walls of the recessed portion may be inclined.

A width of the recessed portion may increase in a direction from the cleaning unit to the container.

Features and/or utilities of the present general inventive concept may also be realized by a developer comprising a photoconductive drum and a cleaning member that removes waste toner from the photoconductive drum after image development. The developer may include a waste toner container including a cleaning unit in which the photoconductive drum and the cleaning member are installed, and a container spaced apart from the cleaning unit, an upper frame constituting an upper wall of the waste toner container, and a recessed portion depressed downwardly in a center portion of the upper frame.

The developer may further include a waste toner transporting member that is installed in the waste toner container and transports the waste toner to the container from the cleaning unit.

The waste toner transporting member may move back and forth and upward and downward.

The waste toner transporting member may include a plurality of horizontal ribs that are spaced apart from each other in a direction of the back-and-forth movement and a plurality of spaces for transporting the waste toner is formed between the plurality of horizontal ribs. The widths of the spaces may gradually decrease in a direction from the cleaning unit toward the container. Chamfered portions may be formed at edges of plurality of horizontal ribs facing the cleaning unit.

Features and/or utilities of the present general inventive concept may also be realized by an electrophotographic image forming apparatus including a developer comprising a photoconductive drum and a cleaning member that removes waste toner from the photoconductive drum after development. The developer may include a waste toner container comprising a cleaning unit in which the photoconductor and the cleaning member are installed, and a container spaced apart from the cleaning unit, an upper frame constituting an upper wall of the waste toner container, and a recessed portion depressed downwardly in a center portion of the upper frame.

The developer may further include a waste toner transporting member that is installed in the waste toner container, transports the waste toner to the container from the cleaning unit, and moves back and forth and upward and downward. The waste toner transporting member may include a plurality of horizontal ribs that are spaced apart from each other in a direction of the back-and-forth movement, a plurality of spaces for transporting the waste toner may be formed between the plurality of horizontal ribs, and widths of the spaces may gradually decrease from the cleaning unit toward the container.

Features and/or utilities of the present general inventive concept may also be achieved by a developer including a photoconductive drum to form an image thereon, a cleaning member to remove waste toner from the photoconductive drum, a waste toner storage area to store the waste toner, and a waste toner transport member to move the waste toner from the cleaning member to the waste toner storage area. The waste toner transport member may move back and forth in a first direction and a second direction, respectively, and up and down, to move the toner from the cleaning member to the waste toner storage area.

The developer may further include a rotation member, and a first end of the waste toner transport member may be connected to the rotation member at a point offset from a rotation center of the rotation member to cause the waste toner transport member to move up, down, forward, and backward according to the rotation of the rotation member.

The developer may further include a support member extending between the cleaning member and the waste toner storage area to support toner as the toner moves from the cleaning member to the waste toner storage area.

The waste toner transport member may include a protrusion on a lower surface thereof to contact the support member and to slide along the support member according to the back and forth movement of the waste toner transport member.

The protrusion may be located at a position of the waste toner transport member such that as an end of the waste toner transport member farthest from the cleaning member moves up, the end of the waste toner transport member closest to the cleaning member moves down to move closer to the cleaning member.

The support member may include an inclined portion and an extended portion, the cleaning member being mounted to the inclined portion and the extended portion extending between an end of the inclined portion and the waste toner storage area.

The developer may further comprise a support member extending between the cleaning member and the waste toner storage area to support toner as the toner moves from the cleaning member to the waste toner storage area, the waste toner transport member may include a protrusion on a lower surface thereof to contact the support member and to slide along the support member according to the back and forth movement of the waste toner transport member, the support member may include an inclined portion and an extended portion, the cleaning member being mounted to the inclined portion and the extended portion extending between an end of the inclined portion and the waste toner storage area, and the protrusion of the waste toner transport member may be located at a position on the waste toner transport member such that when the first end of the waste toner transport member connected to the rotation member moves in the second direction toward the cleaning member, the protrusion slides from the extended portion of the support member to the inclined portion of the support member.

As the first end of the waste toner transport member moves from a backward-most rotation point in the first direction of the rotation member toward an upper-most rotation point, a second end of the waste toner transport member adjacent to the cleaning member may move downward closer to the cleaning member and in the second direction.

The waste toner transport member may include a plurality of ribs extending in a third direction perpendicular to the first direction and corresponding to a length-wise direction of the photoconductive drum and a plurality of spaces located between the plurality of ribs.

Each space may have a width larger than each adjacent space in the first direction.

A stroke length of the waste toner transport member may be larger than a combined width of each rib respectively combined with each adjacent space. A side of each rib facing the second direction may have a chamfered portion.

The developer may further include an upper wall located at least above the cleaning member and including a recessed portion at a location corresponding to a center of the photoconductive drum in the lengthwise direction of the photoconductive drum.

The developer may further include a support member extending between the cleaning member and the waste toner storage area to support toner as the toner moves from the cleaning member to the waste toner storage area, and the recessed portion may be located above the support member.

Each side of the recessed portion in the lengthwise direction of the photoconductive drum may be inclined with respect to an upper surface of the upper wall.

Features and/or utilities of the present general inventive concept may also be realized by an image forming apparatus including a developer to form an image on a recording medium, and an exposing unit to provide light to the developer to form the image.

Features and/or utilities of the present general inventive concept may also be realized by a developer including a photoconductive drum to form an image thereon, a cleaning member to clean waste toner from the photoconductive drum, a waste toner storage area to store the waste toner, a connecting area located between the cleaning member and the waste toner storage area, and an upper wall located at least above the connecting area, the upper wall including a recessed portion that is recessed downward, the recessed portion located in the upper wall at a location corresponding to a center of the photoconductive drum in a lengthwise direction of the photoconductive drum.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

Figure 1:
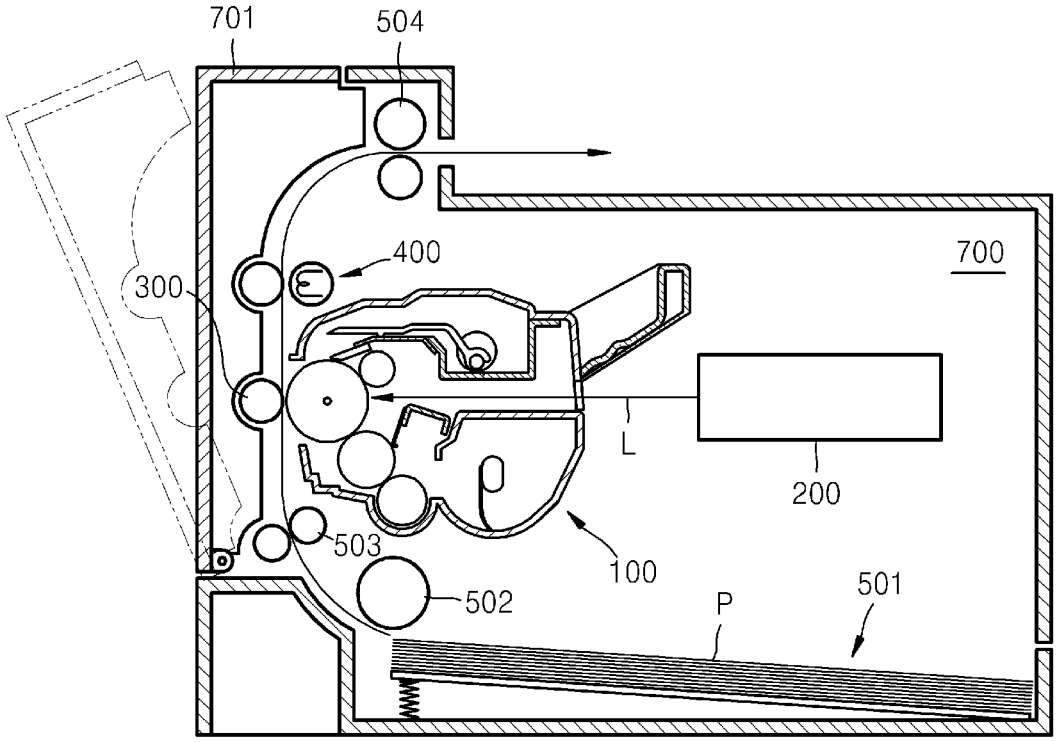
FIG. 1 is a diagram of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
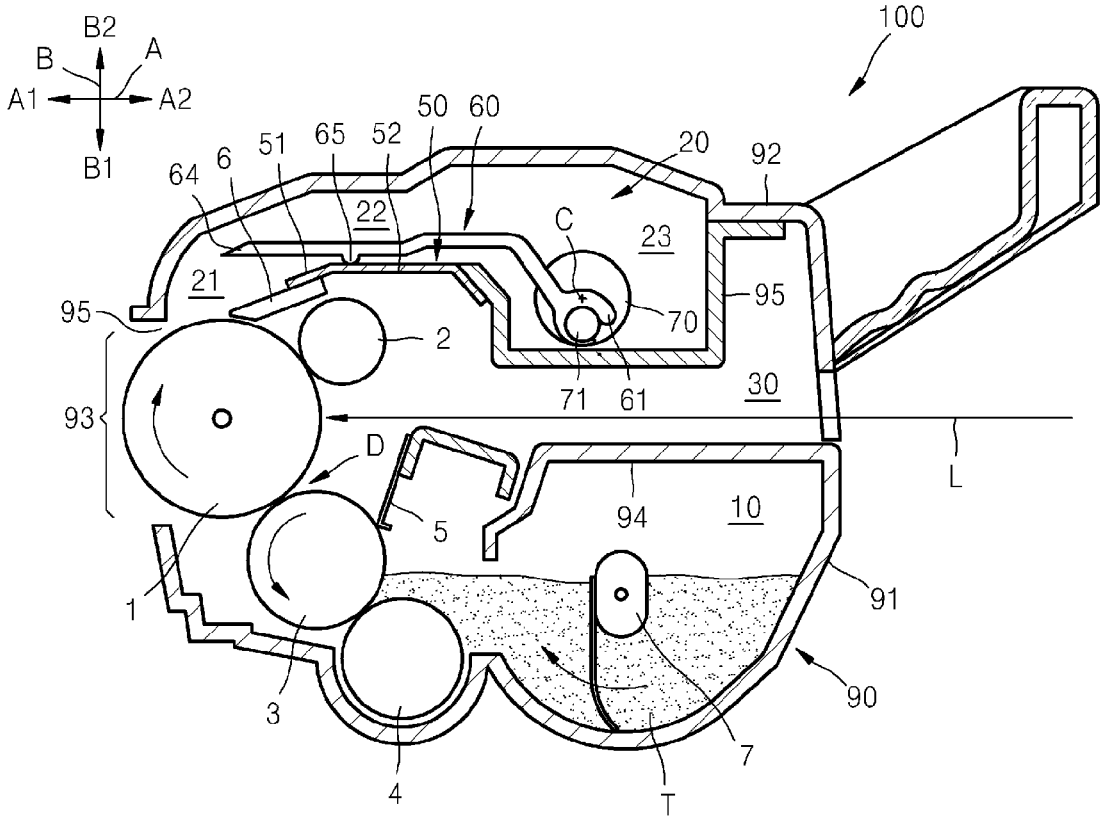
FIG. 2 is a diagram of a developer according to an embodiment of the present general inventive concept.

FIG. 1 is a diagram of an image forming apparatus according to an embodiment of the present general inventive concept and FIG. 2 is a diagram of a developer 100 included in the image forming apparatus of FIG. 1 according to an embodiment of the present general inventive concept. The developer 100 according to the current embodiment is an integration-type developer including a photoconductive drum 1 and a developing roller 3.

Referring to FIG. 2, the photoconductive drum 1, an example of a photoconductor on which an electrostatic latent image is formed, includes a cylindrical metal pipe and a photoconductive layer formed on the circumference of the cylindrical metal pipe. A charging roller 2 is an example of a charger which charges the surface of the photoconductive drum 1 with a uniform electric potential. A charging bias voltage is applied to the charging roller 2. A corona charger may be used instead of the charging roller 2. The developing roller 3 applies toner to the electrostatic latent image formed on the surface of the photoconductive drum 1 and develops the electrostatic image into a toner image. In the current embodiment, a contact development method is used, wherein the developing roller 3 and the photoconductive drum 1 contact each other to form a development nip D. In this case, the developing roller 3 may include an elastic layer (not illustrated) formed on the circumference of a conductive metal core (not illustrated). When a developing bias voltage is applied to the developing roller 3, toner T is transferred and attached to the electrostatic latent image formed on the surface of the photoconductive drum 1 through the development nip D. If a non-contact development method is used, the surface of the developing roller 3 and the surface of the photoconductive drum 1 are spaced apart from each other by an interval of about few hundreds microns.

The developer 100 may further include a supply roller 4 to attach toner T to the developing roller 3. A supply bias voltage may be applied to the supply roller 4 in order to attach toner T to the developing roller 3. A regulator 5 regulates an amount of toner attached to the developing roller 3. The regulator 5 may be, for example, a regulator blade of which front end contacts the developing roller 3 with a predetermined pressure. A cleaning member 6 removes the remaining toner and foreign bodies from the surface of the photoconductive drum 1 before charging. The cleaning member 6 may be, for example, a cleaning blade of which front end contacts the surface of the photoconductive drum 1. Hereinafter, the foreign bodies removed from the surface of the photoconductive drum 1 are referred to waste toner.

The developer 100 includes a toner container 10 and a waste toner container 20. The waste toner container 20 stores waste toner removed from the surface of the photoconductive drum 1. The developer 100 illustrated in FIG. 1 uses a one-component developing agent, toner T. The toner T is stored in the toner container 10.

The toner container 10 includes an agitator 7 that transfers toner to the developing roller 3. The agitator 7 may agitate toner T and charge the toner T with a predetermined electric potential. In FIG. 1, one agitator 7 is illustrated, however, the present general inventive concept is not limited thereto. An appropriate number of agitators 7 may be installed in an appropriate position of the toner container 10 in order to efficiently supply toner T to the developing roller 3 in consideration of the capacity and shape of the toner container 10. The agitator 7 may include one or more agitating blades in the form of a flexible film on a rotation shaft. The agitator 7 may be an auger having a spiral blade.

When a two-component developing agent including a toner and carrier is used, the toner container 10 stores the carrier and toner. In this case, the developing roller 3 may include a magnet in a rotating sleeve. Due to the magnetic force of the magnet, the carrier is attached to the circumference of the developing roller 3 and the toner is attached to the carrier by an electrostatic force so that a magnetic brush formed of carrier and toner is formed on the circumference of the developing roller 3. Due to the developing bias voltage applied to the developing roller 3, only toner is transferred to the electrostatic latent image formed on the photoconductive drum 1. The regulator 5 is spaced apart from the surface of the developing roller 3 by a predetermined distance and regulates a height of the magnetic brush formed on the circumference of the developing roller 3. The agitator 7 transfers the carrier and toner to the developing roller 3. The agitator 7 may also agitate the carrier and toner, thereby friction-charging the toner.

A housing 90 of the developer 100 may include a lower frame 91 and an upper frame 92. A part of the photoconductive drum 1 is exposed to the outside of the housing 90 through the opening 93. First and second inside frames 94 and 95 may be included in the housing 90. The lower frame 91 and the first inside frame 94 constitute the toner container 10, and the upper frame 92 and the second inside frame 95 constitute the waste toner container 20. The first inside frame 94 and the second inside frame 95 are spaced apart from each other and an optical path 30, along which light L scanned from an exposing unit 200 of FIG. 1 to expose the photoconductive drum 1 travels, is formed between the first inside frame 94 and the second inside frame 95. In other words, the light L travels along the optical path defined by the space between the first and second inside frames 94 and 95.

Referring to FIG. 1, the developer 100 is installed in a main body 700 of the image forming apparatus through a door 701. The exposing unit 200 scans light modulated according to image information onto the surface of the photoconductive drum 1 charged by a uniform electric potential. For example, a laser scanning unit (LSU) may be used as the exposing unit 200. The LSU deflects light irradiated from a laser diode to a main scanning direction by using a polygon mirror and scans the deflected light onto the photoconductive drum 1.

A transfer roller 300 is a transfer unit located to face the surface of the photoconductive drum 1 and forms a transfer nip. A transfer bias voltage for transferring a toner image developed on the surface of the photoconductive drum 1 to a recording medium P is applied to the transfer roller 300. A corona transfer unit may be used instead of the transfer roller 300.

The toner image transferred onto the surface of the recording medium P by the transfer roller 300 remains on the surface of the recording medium P due to electrostatic attraction. A fixing unit 400 fixes the toner image to the recording medium P by applying heat and pressure to the toner image and a permanent printed image is formed on the recording medium P.

A process of forming an image when the apparatus of FIG. 1 is used is briefly described below. A charging bias voltage is applied to the charging roller 2 and the photoconductive drum 1 is charged with a uniform electric potential. The exposing unit 200 scans light modulated in correspondence to image information onto the photoconductive drum 1 through the optical path 30 in the developer 100 and forms an electrostatic latent image on the surface of the photoconductive drum 1. Toner T is transferred toward the supply roller 4 by the agitator 7 and the supply roller 4 attaches the toner T to the surface of the developing roller 3. The regulator 5 forms a toner layer having a uniform thickness on the surface of the developing roller 3. A developing bias voltage is applied to the developing roller 3. As the developing roller 3 rotates, the toner T transferred to the development nip D is transferred and attached to the electrostatic latent image formed on the surface of the photoconductive drum 1 by a developing bias voltage so that a visible toner image is formed on the surface of the photoconductive drum 1. The recording medium P is removed from a recording medium tray 501 by a pickup roller 502 and transferred by a feeding roller 503 to a transfer nip that faces the transfer roller 300 and the photoconductive drum 1. When a transfer bias voltage is applied to the transfer roller 300, the toner image is transferred to the recording medium P due to electrostatic attraction. Then, the toner image transferred to the recording medium P is fixed onto the recording medium P by the fixing unit or fusing unit 400 that applies heat and pressure to the toner image and thus printing is completed. The recording medium P is discharged by a discharge roller 504. Toner T that is not transferred to the recording medium P and remains on the photoconductive drum 1 is removed by the cleaning member 6 and is stored in the waste toner container 20.

Referring to FIG. 2, the waste toner container 20 may include a cleaning unit or area 21, a container or storage area 23, and a connecting unit or area 22. In the cleaning area 21, the cleaning member 6 contacts a surface of the photoconductive drum 1 to remove the waste toner. The storage area 23 is spaced apart from the cleaning area 21, and the connecting area 22 connects the cleaning area 21 and the storage area 23. The waste toner removed from the surface of the photoconductive drum 1 is piled up on the cleaning unit 21 until it fills the cleaning area 21 and is gradually transferred to the connecting area 22 and the storage area 23.

After printing of an image is completed, an internal temperature of the image forming apparatus gradually decreases by residual heat of the fixing unit 400. Thus, the waste toner in the waste toner container 20, in particular, the cleaning area 21, may be hardened by residual heat of the fixing unit 400 and be transformed into a lump. Also, the lump-form waste toner is attached to the front end of the cleaning member 6 and interrupts a transfer of the waste toner to the waste toner storage area 23 so that the waste toner may leak to the outside through a gap 95 between the photoconductive drum 1 and the housing 90.

The developer 100 according to an embodiment of the present general inventive concept includes a waste toner transporting member 60 installed in the waste toner container 20 to transfer the waste toner from the cleaning area 21 to the waste toner storage area 23. The waste toner transporting member 60 according to the current embodiment moves back and forth in the waste toner container 20 in directions A 1 and A2. In the present specification and claims, the direction A1 may be referred to as a front or forward direction and the direction A2 may be referred to as a rear or backward direction. In addition, the axis defined by the directions A1 and A2 may be referred to as the front-back axis A.

In addition, a front end 64 of the waste toner transporting member 60 moves perpendicularly in the directions B1 and B2 as the toner transporting member moves back-and-forth. Throughout the present specification and claims, the direction B1 may be referred to as down or a downward direction, and the direction B2 may be referred to as up or an upward direction. Directions B1 and B2 define a vertical axis B. Due to a combination of the back-and-forth movement of the waste toner transporting member 60 and the upward-and-downward movement of the front end 64, the lump waste toner in the cleaning area 21 is crushed. Due to the back-and-forth movement of the waste toner transporting member 60, the waste toner is moved to the waste toner storage area 23 from the cleaning area 21.

Figure 3:
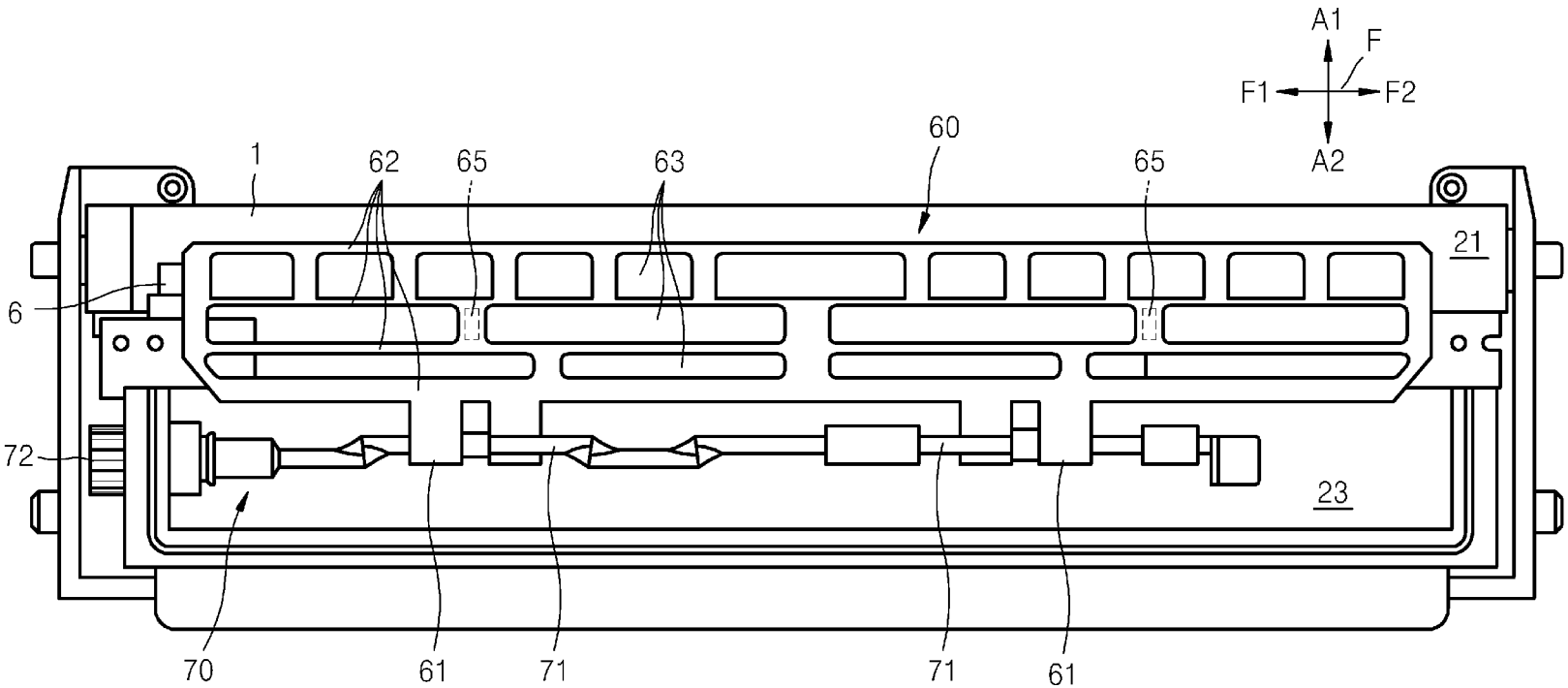
FIG. 3 is a plan view of the developer of FIG. 2 from which an upper frame is removed, according to an embodiment of the present general inventive concept.

FIG. 3 is a plan view of the developer 100 of FIG. 2 from which the upper frame 92 is removed, according to an embodiment of the present general inventive concept. Referring to FIGS. 2 and 3, a rotation member 70 including an eccentricity unit 71 that is eccentric with respect to the rotation center C of the rotation member 70 is installed in the developer 100. The eccentricity unit 71 may be, for example, a rod that has a center axis offset from the center rotation axis C of the rotation member 70. The rotation member 70 may be located in the storage area 23. A gear 72 is installed at one end of the rotation member 70. When the developer 100 is installed in the image forming apparatus, the gear 72 is connected to a driving unit (not illustrated) included in the image forming apparatus and is rotated.

The waste toner transporting member 60 extends toward the cleaning area 21 from the waste toner storage area 23. The end 61 of the waste toner transporting member 60 that is located in the storage area 23 is connected to the eccentricity unit 71 so as to be rotated. The waste toner transporting member 60 may include a plurality of horizontal ribs 62 that are spaced apart from each other in the back-and-forth movement directions A1 and A2 and that extend lengthwise along the horizontal axis F. As the waste toner is inserted into spaces 63 defined by the plurality of horizontal ribs 62 when the waste toner transporting member 60 moves back and forth, the waste toner is moved to the waste toner storage area 23 from the cleaning area 21 through the connecting area 22.

The connecting area 22 includes a support unit 50 that supports the waste toner transporting member 60. The support unit 50 contacts the waste toner transporting member 60 and guides the waste toner transporting member 60 to be moved back and forth and upward and downward. The support unit 50 may be disposed below the waste toner transporting member 60 in the direction B1. The waste toner transporting member 60 may include a support protrusion 65 that contacts the support unit 50 and slides along the support unit 50 as the waste toner transport member 60 moves back and forth. One or more support protrusions 65 may be prepared in a transverse direction, or in the horizontal direction along the axis F. The support unit 50 may include an inclined portion 51 and an extended portion 52. The inclined portion 51 is inclined upward from the cleaning area 21 toward the connecting area 22. The extended portion 52 extends toward the waste toner storage area 23 and has an inclination angle that is gentler than that of the inclined portion 51.

Figure 19A:
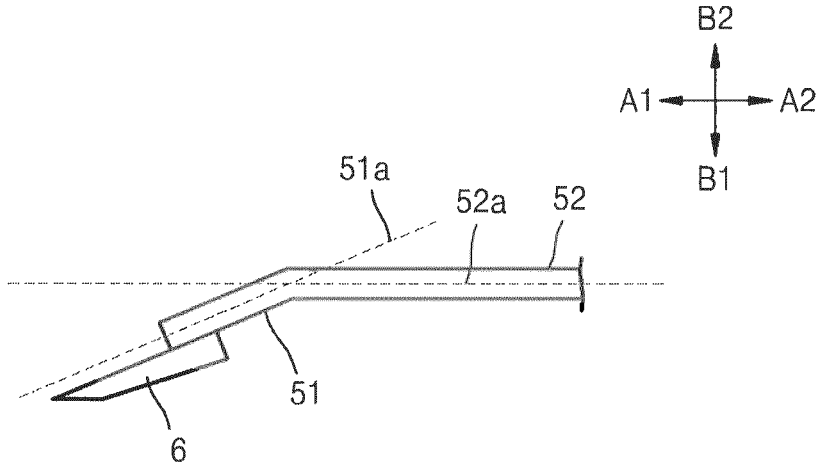
FIGS. 19A-19D illustrate inclination angles of the inclined portion and the extended portion of a support member.
Figure 19B:
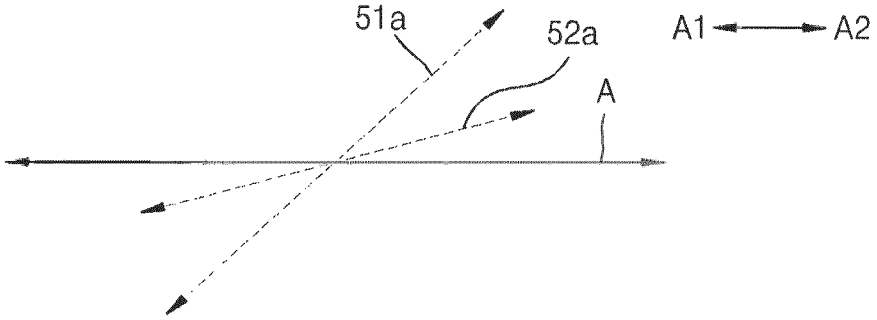

FIGS. 19A-19D illustrate an inclination angle of the inclined portion 51 of the support unit 50 with respect to the extended portion 52 and the axis A, which may be a horizontal axis. As illustrated in FIG. 19A, the inclined portion 51 has a center axis 51*a* and the extended portion 52 has a center axis 52*a*. The center axis 51*a* of the inclined portion 51 is inclined at a greater angle than the center axis 52*a* of the extended portion 52. As illustrated in FIG. 19B, each of the center axes 51*a* and 52*a* may be inclined with respect to the axis A in the direction A2. In other words, the inclined portion 51 and the extended portion 52 may both be inclined upwards from front to back.

Figure 19C:
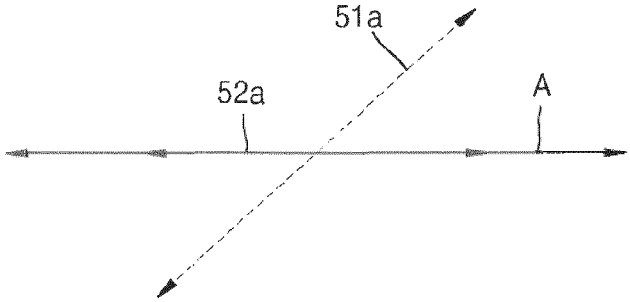

FIG. 19C illustrates an embodiment in which the center axis 52*a* of the extended portion 52 is co-linear with the axis A. For example, if the axis A represents a horizontal axis, then the extended portion 52 may be horizontal and may have no inclination.

Figure 19D:
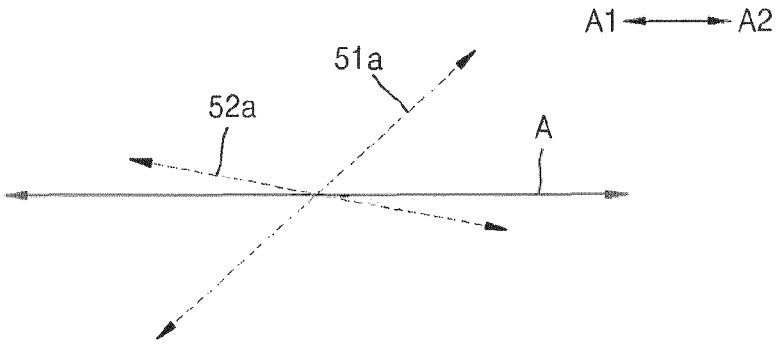

FIG. 19D illustrates an embodiment in which the center axis 52*a* of the extended portion is inclined in the direction A1, while the center axis 51*a* of the inclined portion 51 is inclined in the direction A2. In other words, while the inclined portion 51 may be inclined at an angle to capture waste toner from the cleaning area 21 and to provide a mounting surface for the cleaning member 6, the extended portion 52 may be inclined at an angle to allow toner to more easily flow from the cleaning area 21 through the connecting area 22 to the waste toner storage area 23.

The support unit 50 may be a bracket to fix or attach the cleaning member 6 to the housing 90. That is, the cleaning member 6 is installed at the bracket and the bracket may be installed at the housing 90, for example, the second inside frame 95. According to the above structure, the form or shape of the support unit 50 may be changed or modified in the developer 100 by changing or replacing the bracket, and thus a motion of the waste toner transporting member 60 may be changed so as to efficiently transfer waste toner.

Figure 4:
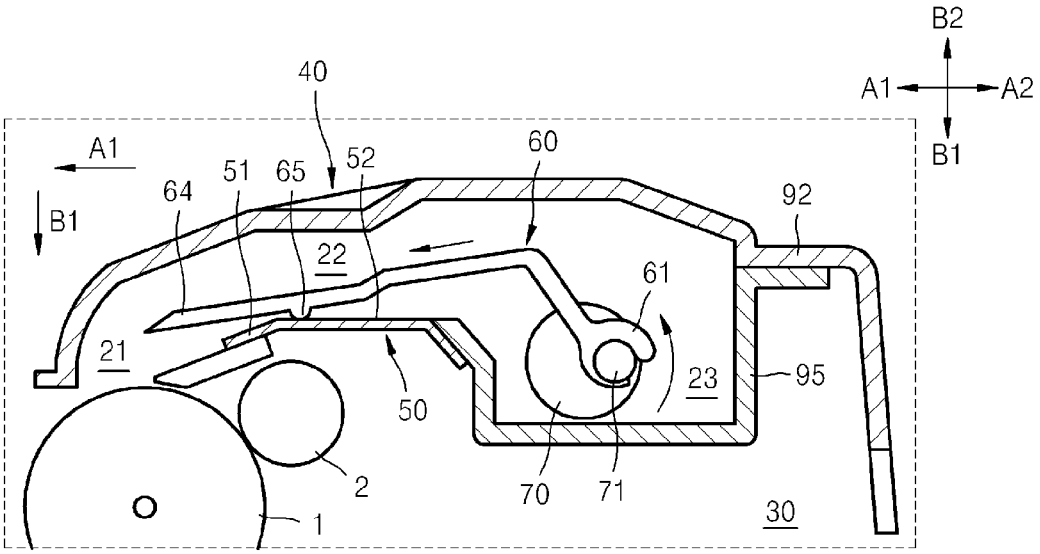
FIGS. 4 through 7 are diagrams for explaining operation of a waste toner transporting member.

FIGS. 4 through 7 are diagrams to explain operation of the waste toner transporting member 60. Referring to FIG. 4, the waste toner transporting member 60 is located in a retreated position toward the rear wall of the waste toner storage area 23 in the direction A2. The eccentricity unit 71 of the rotation member 70 is located at a right dead point of the eccentricity unit 71, or an extreme rotation point of the eccentricity unit 71 in the direction A2. The support protrusion 65 of the waste toner transporting member 60 is supported by the extended portion 52 of the support unit 50. When the rotation member 70 is rotated in a counter-clockwise direction toward the top dead point, or the apex in the direction B2, the end 61 of the waste toner transporting member 60 gradually moves upward in the direction B2 and forward in the direction A1. Consequently, the waste toner transporting member 60 rotates on the protrusion 65 resting on the extended portion 52 of the supporting member 50, and the end 64 of the waste toner transporting member moves gradually downward in the direction B1 and forward in the direction A1.

As the end 61 of the waste toner transporting member 60 moves from the right dead point of the eccentricity unit 71 to the top dead point of the eccentricity unit 71, the protrusion 65 slides along the supporting member 50 in the forward direction A1 causing the end 64 of the waste toner transporting member 60 to move forward in the direction A1. As the end 64 moves forward, it may press into waste toner that may be built up in the cleaning area 21.

Figure 5:
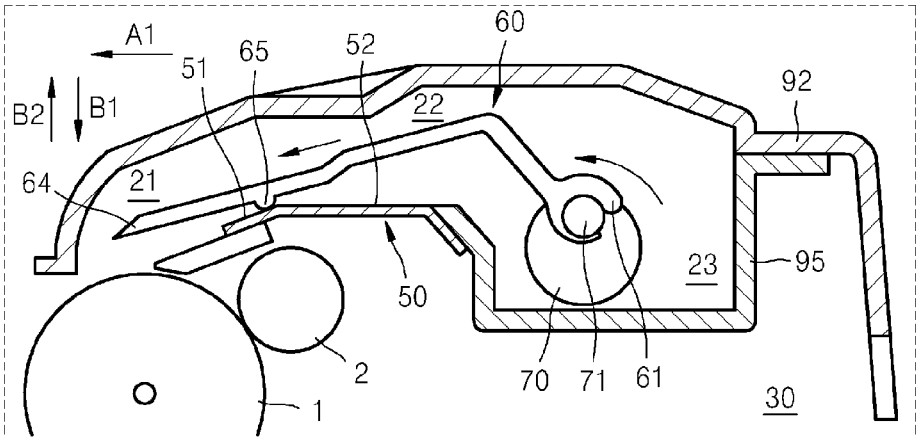

As illustrated in FIG. 5, when the eccentricity unit 71 of the rotation member 70 reaches the top dead point, the support protrusion 65 is supported by the inclined portion 51, and the end 64 of the waste toner transporting member 60 is guided by the inclined portion 51 downward into the cleaning area 21. Due to the forward movement in the direction A1 and the downward movement in the direction B1, the front end part 64 of the waste toner transporting member 60 penetrates the waste toner contained in the cleaning area 21 and crushes the lump waste toner so that the waste toner is filled in the spaces 63 interposed between the plurality of ribs 62.

As the rotation member 70 is rotated in the counter-clockwise direction and the eccentricity unit 71 of the rotation member 70 moves toward the left dead point, the end 61 of the waste toner transporting member 60 gradually moves downward, and the front end 64 of the waste toner transporting member 60 gradually rotates upward, that is, in the direction B2.

Figure 6:
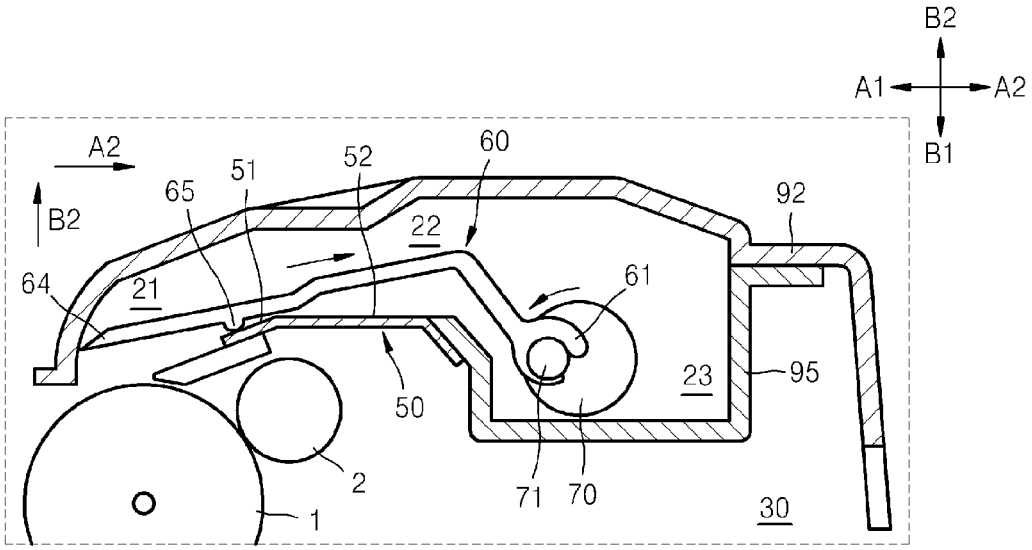

As illustrated in FIG. 6, when the eccentricity unit 71 of the rotation member 70 reaches the left dead point, the waste toner transporting member 60 changes its moving direction and moves in the direction A2, that is, toward the rear of the waste toner storage area 23. The front end 64 of the waste toner transporting member 60 is moved upward in the direction B2.

Figure 7:
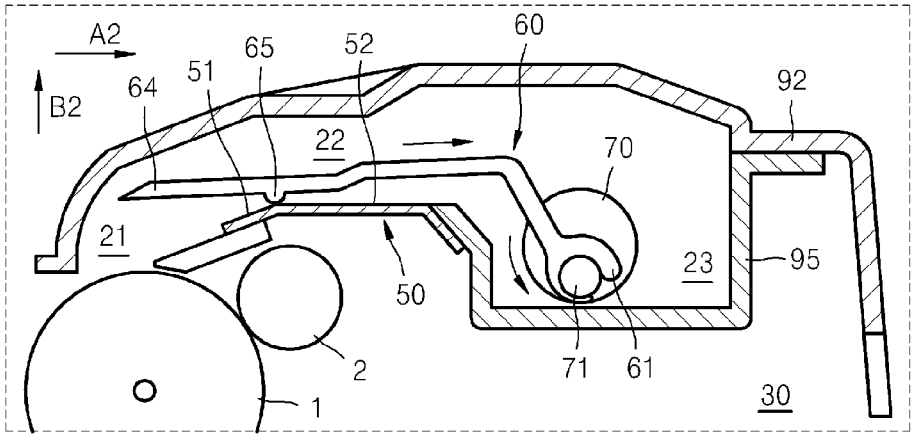

As illustrated in FIG. 7, when the eccentricity unit 71 of the rotation member 70 passes a lower dead point, or a nadir in the direction B1, the support protrusion 65 is supported by the extended portion 52 again. When the eccentricity unit 71 moves toward the right dead point, or an extreme point in the direction A2, as illustrated in FIG. 4, due to the rotation of the rotation member 70, the waste toner is inserted into the spaces 63 interposed between the plurality of horizontal ribs 62 and is transferred to the waste toner container 20.

As described above, while the waste toner transporting member 60 moves back and forth in the directions A1 and A2, the front end 64 of the waste toner transporting member 60 moves upward and downward in the directions B1 and B2 in the cleaning area 21. Due to a combination of the back-and-forth movement and the upward-and-downward movement, the lump waste toner in the cleaning area 21 is crushed and easily moved to the waste toner container 20. Also, as the support protrusion 65 contacts the support unit 50 by a sliding motion, the back-and-forth movement and upward-and-downward movement of the waste toner transporting member 60 are guided and thus the waste toner transporting member 60 may be easily assembled.

Figure 20:
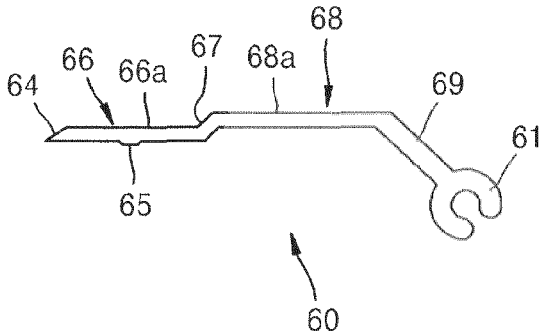
FIG. 20 illustrates an example of a waste toner transporting member.

FIG. 20 illustrates an example of a waste toner transporting member 60. The waste toner transporting member 60 may include a front portion 66 and a rear portion 68. The front portion 66 may include the front end 64 which may be chamfered to penetrate toner located in a cleaning area 21 of a developer 100. The front portion 66 may also include one or more protrusions 65 extending from a bottom surface of the waste toner transporting member 60 to slide along and rotate about a surface. The rear portion 68 may include a main part 68*a* that may be parallel to a main part 66*a* of the front portion 66. The front portion 66 and the rear portion 68 may be offset from each other in a vertical direction B2 by a connecting part 67. The rear portion may also include an arm 69 to connect to the end 61, and the end 61 may connect to a rotating member 70 to cause the waste toner transporting member to move up, down, forward, and backward, as discussed above.

Figure 8:
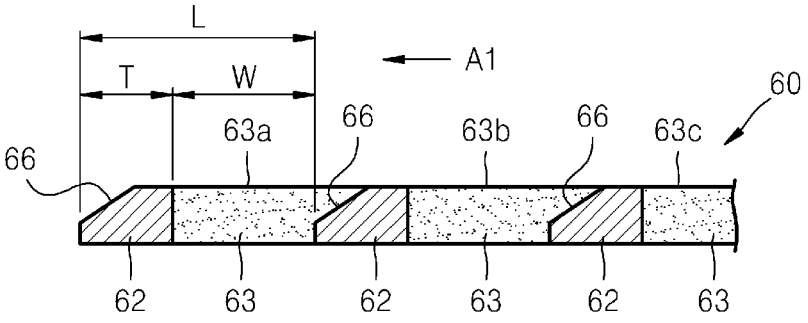
FIG. 8 is a cross-sectional diagram of a front end part of a waste toner transporting member.

Referring to FIG. 8, as the waste toner transporting member 60 moves back and forth, the waste toner moves to the waste toner storage area 23 sequentially through a space 63*a*, a space 63*b*, and a space 63*c*. Chamfered portions 66 may be prepared on the edges of the plurality of ribs 62 toward the cleaning area 21. Accordingly, when the waste toner transporting member 60 moves to the cleaning area 21, that is, in the direction A 1, the waste toner may easily pass the chamfered portions 66 and may be easily inserted into the spaces 63*a*, 63*b*, and 63*c* interposed between the plurality of ribs 62. If the plurality of ribs 62 have the same the thickness T and the spaces 63*a*, 63*b*, and 63*c* have the same widths W, a stroke length of the waste toner transporting member 60 may be set to be larger than T+W.

When the waste toner remains in the spaces 63*a*, 63*b*, and 63*c*, the waste toner that is left in the spaces 63*b* and 63*c* may harden when the image forming apparatus does not operate. Accordingly, after an image forming process is completed and the back-and-forth movement of the waste toner transporting member 60 is completed, it is preferable that the waste toner should not remain in the spaces 63*a*, 63*b*, and 63*c*. If the widths W of the spaces 63*b* and 63*c* are larger than that of the space 63*a* and the stroke length of the waste toner transporting member 60 is not long enough for the space 63*a* to cover the space 63*b* or for the space 63*b* to cover the space 63*c* with the stroke length, the waste toner that is not transferred remains always in the spaces 63*b* and 63*c*. To prevent such an occurrence, the widths of the spaces 63*a*, 63*b*, and 63*c* may sequentially decrease. In other words, the length of the space 63*a* may be greater than that of the space 63*b*, and the width of the space 63*b* may be greater than that of the space 63*c*. A stroke length of the waste toner transporting member 60 may be set to be larger than the sum of the width of the space 63*a* and the thickness T of the horizontal rib 62. Accordingly, the waste toner may be accurately sequentially moved to the waste toner storage area 23 through the spaces 63*a*, 63*b*, and 63*c* due to the back-and-forth movement of the waste toner transporting member 60. In order to set the widths of the spaces 63*a*, 63*b*, and 63*c* to decrease sequentially, the thickness T of each of the horizontal ribs 62 may be set to gradually increase from the cleaning area 21 to the storage area 23 if intervals L between the plurality of horizontal ribs 62 are the same as each other. A stroke length of the waste toner transporting member 60 may be set to be larger than intervals L.

As the center portion of the photoconductive drum 1 in the side-to-side lengthwise axis F is mainly used in forming an image as compared to end portions of the photoconductive drum 1, waste toner may be mainly generated in the center portion. The waste toner removed from the photoconductive drum 1 is piled up on the cleaning area 21, and an amount of waste toner collected in the center portion of the cleaning area 21 increases. Then, as pressure of the waste toner in the center portion of the cleaning unit 21 increases compared with end portions of the cleaning area 21, toner may leak through the gap 95 of FIG. 2 between the photoconductive drum 1 and the housing 90.

Figure 9:
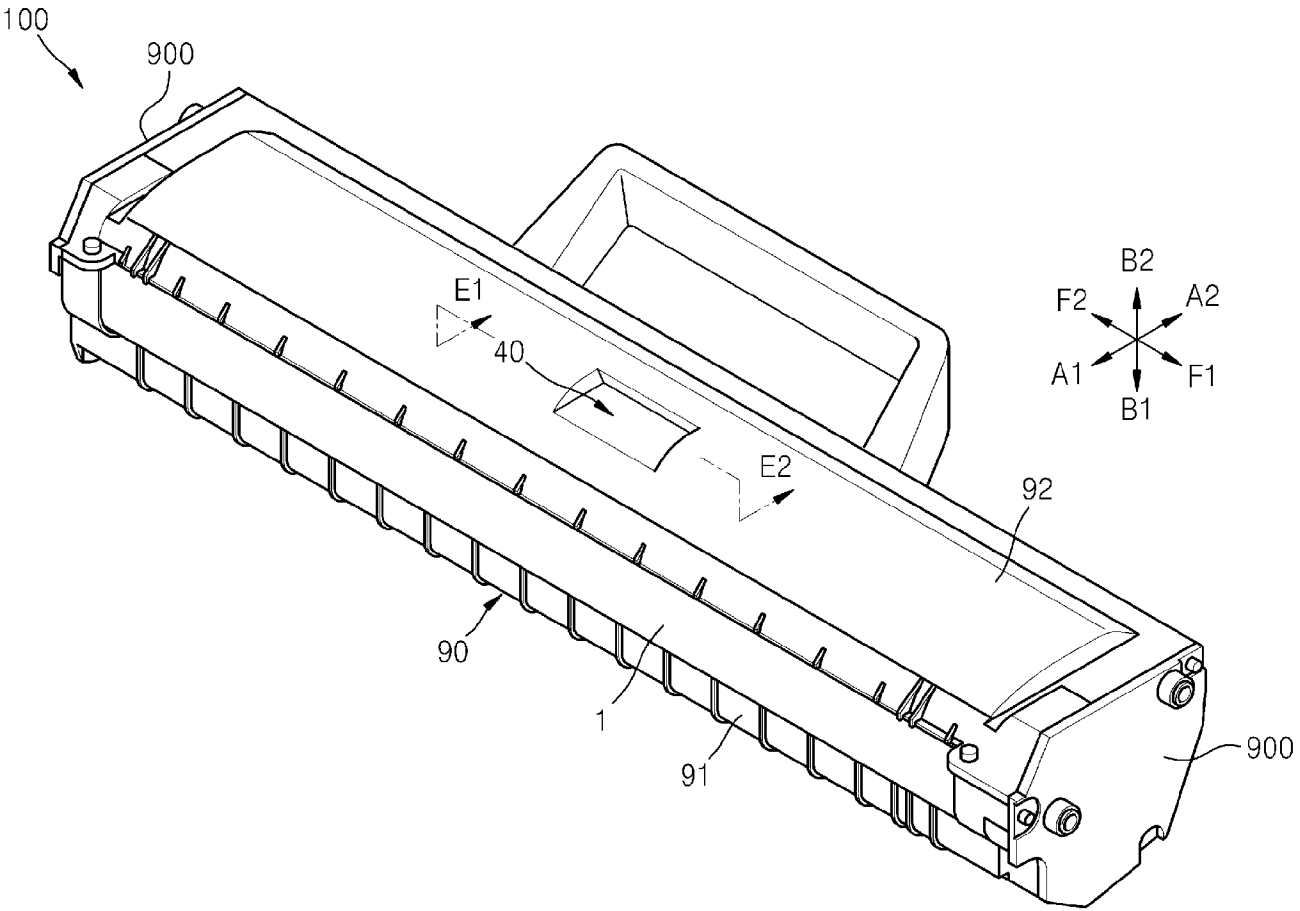
FIG. 9 is a perspective view of the developer of FIG. 2 including a recessed portion.
Figure 10A:
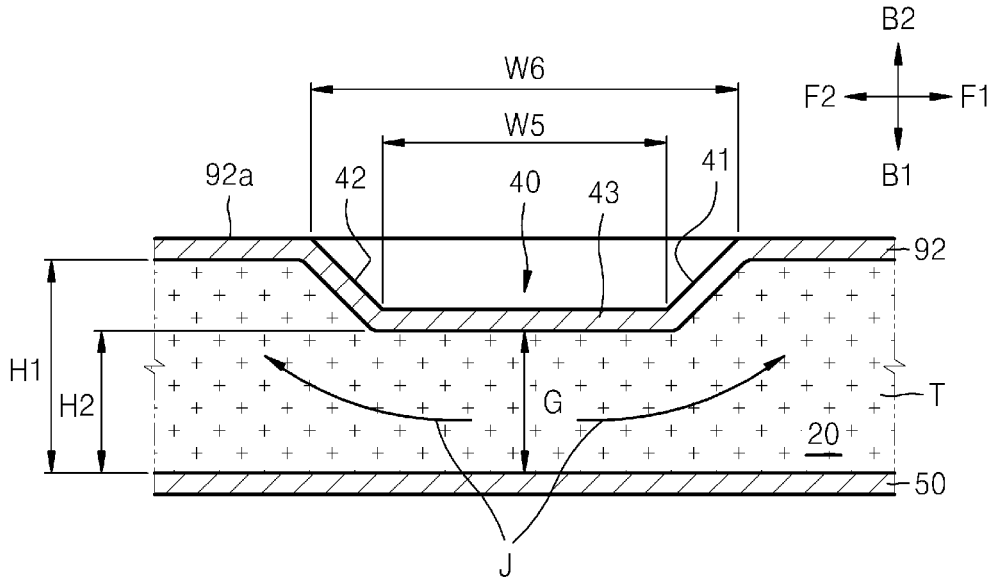
FIG. 10A is a cross-sectional diagram of the developer of FIG. 9 cut along the line E1-E2 of FIG. 9.

FIG. 9 is a perspective view of the developer 100 according to an embodiment of the present general inventive concept and FIG. 10A is a cross-sectional diagram of the developer 100 of FIG. 9 cut along the line E1-E2 of FIG. 9. Referring to FIGS. 2, 9, and 10A, the upper frame 92 constitutes an upper wall of the waste toner container 20. A recessed portion 40 depressed downwardly is formed in the center portion of the upper frame 92. The recessed portion 40 may be formed in an area corresponding to the cleaning unit 21 of the upper frame 92, an area corresponding to the connecting area 22, or an area throughout the cleaning area 21 and the connecting area 22. The waste toner removed from the surface of the photoconductive drum 1 by the cleaning member 6 fills the cleaning area 21 and then the photoconductive drum 1 is rotated so that the waste toner gradually moves to the waste toner storage area 23 due to the back-and-forth movement of the waste toner transporting member 60.

As illustrated in FIG. 10A, an interval G between the portion of the waste toner container 20 where the recessed portion 40 is formed and the support unit 50 is narrower than intervals between the both portions of the waste toner container 20 where the recessed portion 40 is not formed and the support unit 50. In other words, the height H2 between a bottom 43 of the recessed portion 40 and the support member 50 is less than a height H1 between a substantially planar upper surface 92*a* of the upper frame 92 and the support member 50. Accordingly, as illustrated by the arrow J, the waste toner is pushed out to either side of the recessed portion 40 and is dispersed to the edge of the waste toner container 20. Thus, pressure of the waste toner may be prevented from increasing in the center portions of the waste toner container 20 and the photoconductive drum 1.

As illustrated in FIG. 10A, walls 41 and 42 of the recessed portion 40 may be inclined so that the waste toner can be easily dispersed. That is, the recessed portion 40 may be formed so that the space between the walls 41 and 42 decreases in a downward direction B1. In particular, the width W5 of the bottom surface 43 of the recessed portion 40 is less than a width W6 of a top of the recessed portion 40.

Figure 10B:
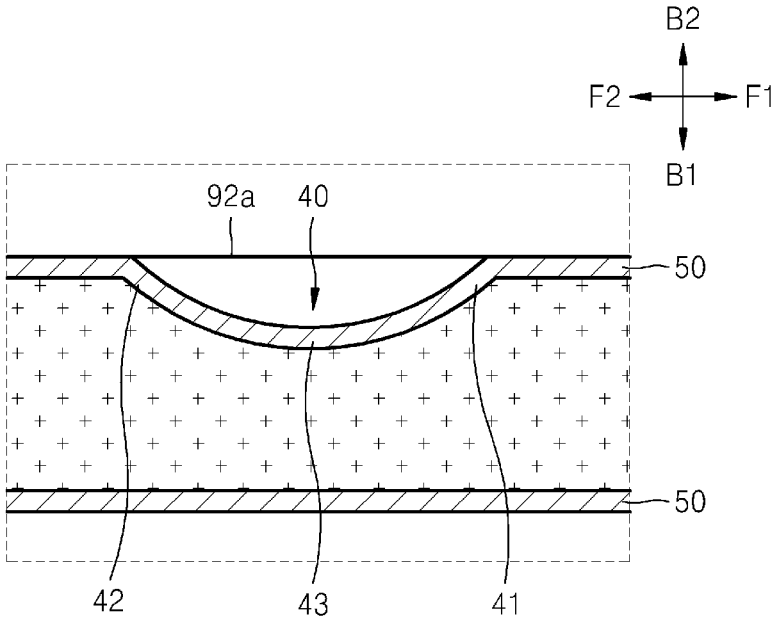
FIGS. 10B and 10C illustrate cross-sectional diagrams of the developer of FIG. 9 cut along the line E1-E2 according to additional embodiments of the present general inventive concept
Figure 10C:
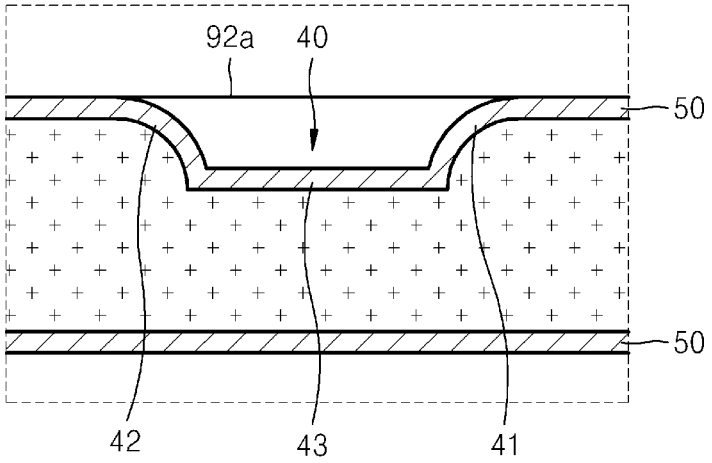

As illustrated in FIGS. 10B and 10C, the side walls 41 and 42 and the bottom surface 43 of the recessed portion 40 may have a convex shape, as illustrated in FIG. 10B or a concave shape, as illustrated in FIG. 10C. However, the surfaces may have any appropriate shape, including combinations of convex and concave shapes within a same recessed portion 40.

Figure 11A:
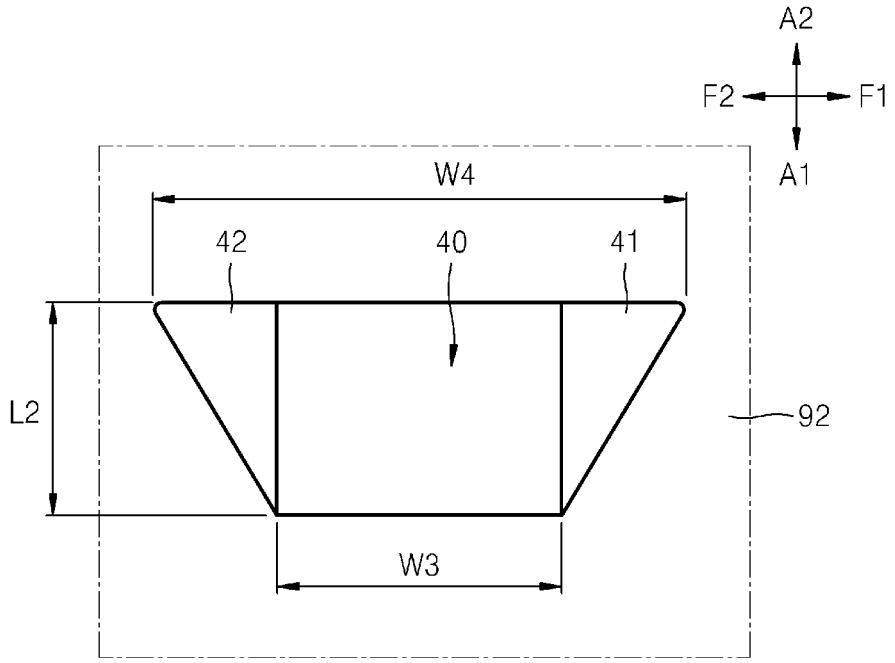
FIG. 11A is a plan view of the recessed portion of FIG. 9.

Also, as illustrated in FIG. 11A, a distance between the walls 41 and 42 of the recessed portion 40 may increase in the direction A2 from the cleaning unit 21 to the connecting area 22. That is, the width W3 at the side closest to the cleaning area 21 may be smaller than the width W4 at the side of the recessed portion 40 closest to the connecting area 22.

Figure 11B:
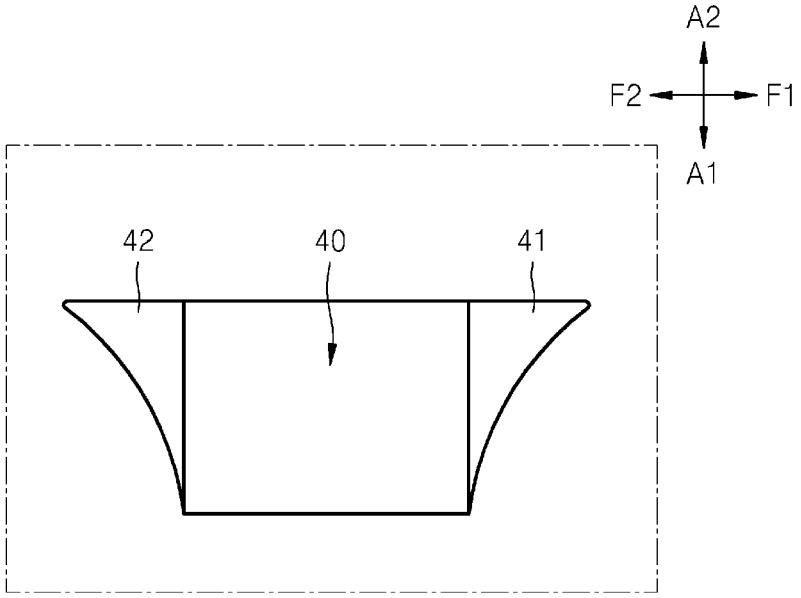
FIGS. 11B and 11C are plan views of the recessed portion of FIG. 9 according to additional embodiments of the present general inventive concept.
Figure 11C:
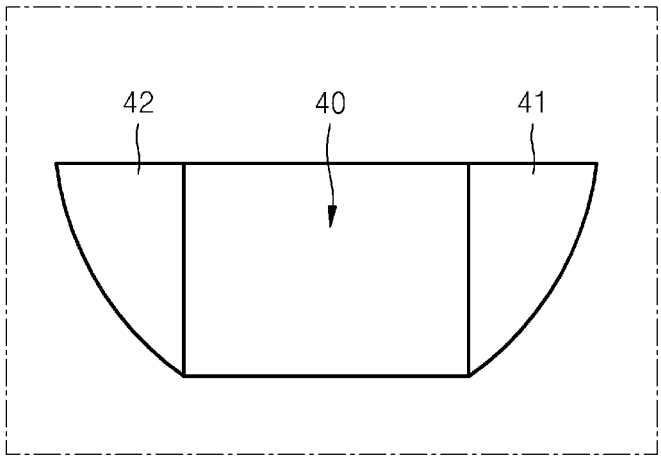

As illustrated in FIGS. 11B and 11C, respectively, the side walls 41 and 42 may have concave or convex shapes, as viewed from a top of the developer unit 100. In addition, the side walls 41 and 42 may have any other appropriate shape.

Figure 11D:
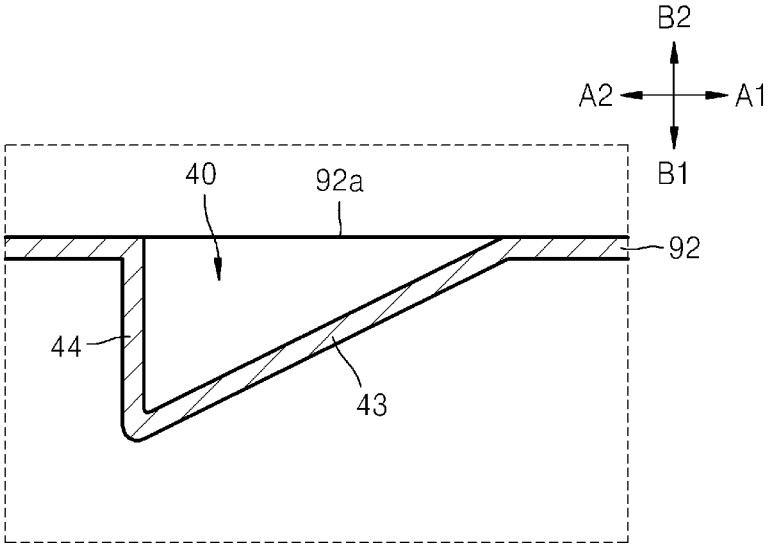
FIGS. 11D-11G are side cross-sectional diagrams of the recessed portion of FIG. 9 according to embodiments of the present general inventive concept.
Figure 11E:
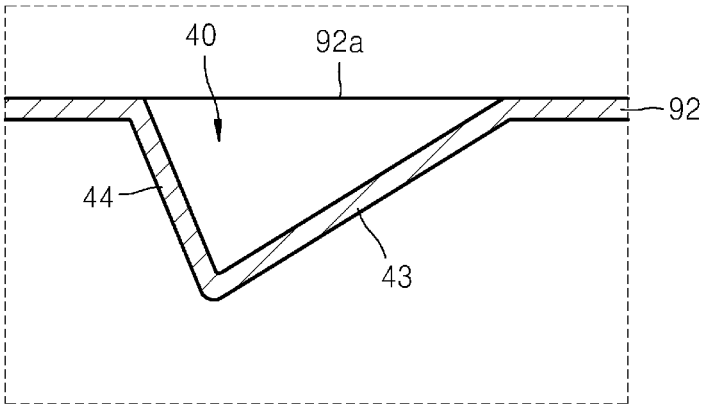

As further illustrated in FIGS. 11D and 11E, a height of the bottom surface 43 of the recessed portion 40 may gradually approach the support member 50 in a direction A2 from a front of the developer 100 to a rear of the developer 100. As illustrated in FIG. 11D, a rear wall 44 of the recessed portion may be a straight vertical line. Alternatively, FIG. 11E illustrates a slanted rear wall 44. In addition, the rear wall 44 may have a convex or concave shape.

Figure 11F:
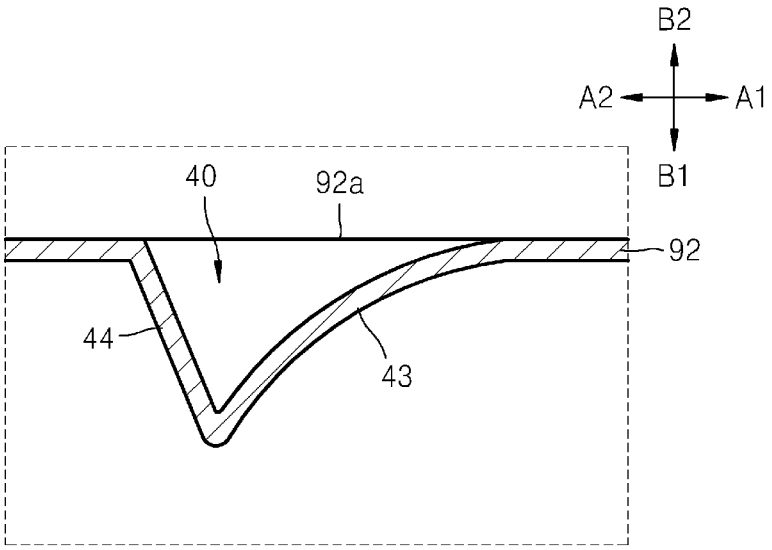
Figure 11G:
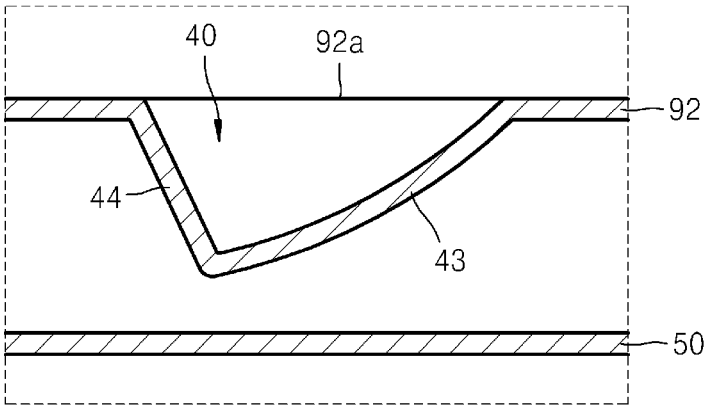

In addition, FIGS. 11F and 11G, respectively, illustrate that the bottom surface 43 of the recessed portion 40 may have a concave shape or a convex shape. In each case, the recessed portion 40 has a front surface in the direction A1 that is flush with the substantially planar outer wall 92*a*. Each location of the recessed portion 40 farther in the direction A2 from the front surface of the recessed portion 40 has a lower surface 43 than each location in the direction A1. In other words, a portion of the recessed portion 40 that is farther in the direction A2 towards the rear of the developer unit 100 is further recessed from the upper surface 92*a* and closer to the support member 50 than a portion farther in the direction A1.

As illustrated in FIG. 11A, the recessed portion 40 has a width W4 at its widest point, which is the point farthest in the rear direction A2. The width W4 may be less than a width of the upper frame 92 of the housing 90. For example, the width W4 may be one third or less the width of the upper frame 92 of the housing. Alternatively, since the recessed portion 40 reduces pressure corresponding to waste toner from the photoconductive unit or drum 1, the width W4 may be less than the width of the photoconductive drum 1, or the width W4 of the recessed portion may be one third or less the width of the photoconductive drum 1.

The recessed portion 40 may further have a length L2 in the front-back direction A1-A2. The length L2 of the recessed portion 40 may be less than a combined length of the cleaning unit or area 21 and the connecting unit or area 22. For example, a front end of the recessed portion 40 may begin over the cleaning area 21 and the rear end of the recessed portion 40 may end over the connecting area 22. Alternatively, the entire recessed portion 40 may be located over the connecting area 22.

Rollers such as the developing roller 3 and the supply roller 4 are installed in the housing 90. The developing and supply rollers 3 and 4 are exposed to the outside of the housing 90 so as to receive a rotation force. The exposed parts of the developing and supply rollers 3 and 4 may be finally supported by support plates 900 combined with side walls of the housing 90 as illustrated in FIG. 9.

Figure 12:
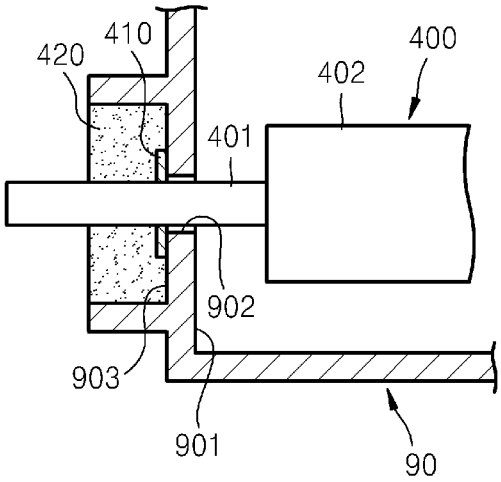
FIG. 12 is a cross-sectional diagram of a sealing structure of a supply roller.

For example, as illustrated in FIG. 12, the supply roller 4 may include a body 402 mounted on a rotation shaft 401. The body 402 may be an elastic body formed of, for example, urethane rubber. The rotation shaft 401 of the supply roller 4 is exposed to the outside through an insertion hole 902 in a side wall 901 of the housing 90. However, toner contained in the housing 90 may leak through a gap between the rotation shaft 401 of the supply roller 4 and the insertion hole 902 and thus a sealing structure to prevent leakage of toner is required.

In FIG. 12, a sealing member 420 is placed in the side wall 901 of the housing 90 in order to prevent leakage of toner through a gap between the insertion hole 902 and the rotation shaft 401. The sealing member 420 according to the current embodiment is formed of a foam-type sealing material which is injected in a liquid state, instantly foamed, solidified, and formed into the sealing member 420. The foam-type sealing material may be a urethane form. A sealing washer 410 is interposed between the side wall 901 of the housing 90 and the sealing member 420 and blocks the liquid state foam-type sealing material from flowing into the housing 90 through the insertion hole 902, when the foam-type sealing material is injected.

Figure 13:
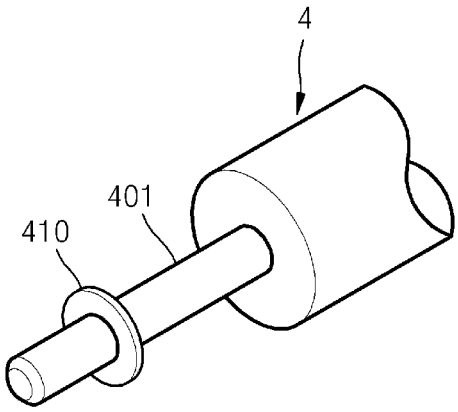
FIG. 13 is a perspective view of a supply roller in which a sealing washer is inserted on a rotation shaft thereof.

Hereinafter, the sealing structure illustrated in FIG. 12 is described more fully. Firstly, as illustrated in FIG. 13, the sealing washer 410 is inserted on the rotation shaft 401 of the supply roller 4.

Figure 14:
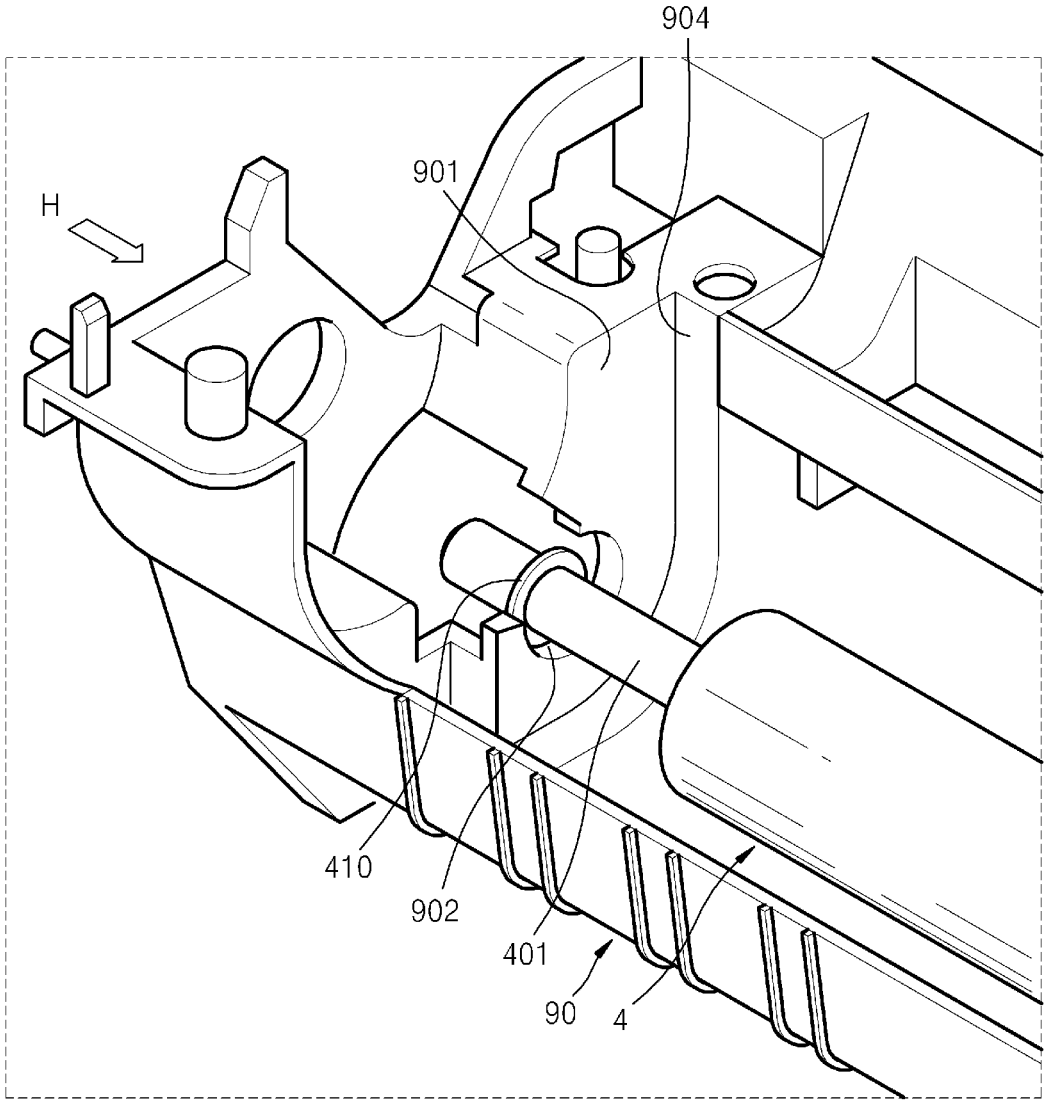
FIG. 14 is a perspective view showing a supply roller with a sealing washer mounted in a housing.

Then, the supply roller 4 is mounted to the housing 90. For example, the supply roller 4 may be mounted to the lower frame 91 before the lower frame has been connected with the upper frame 92. In FIG. 14, the insertion hole 902 may have a cut upper portion to allow the rotation shaft 401 to be easily inserted therein. Through the cut upper portion, the supply roller 4, to which the sealing washer 410 is attached, is mounted the housing 90. Then, the sealing washer 410 is pushed toward the rotation shaft 401, that is, in direction H, until it contacts an outside area 903 of the side wall 901 in FIG. 12.

Figure 15:
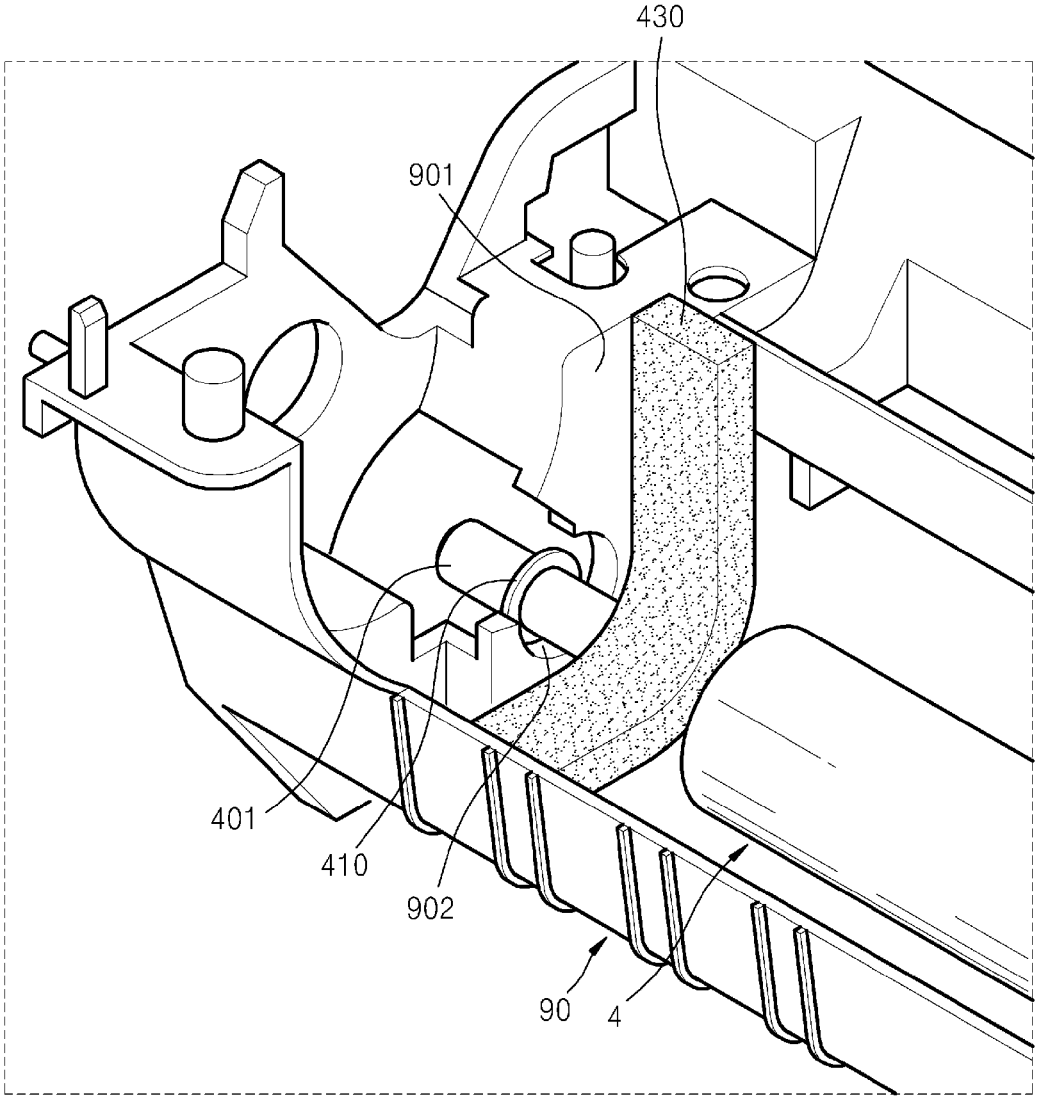
FIG. 15 is a perspective view showing a side sealing member attached to an adhesive surface in order to seal a developing roller.

Next, as illustrated in FIG. 15, an elastic side sealing member 430, for example, a sponge or rubber, may be attached to a contact surface 904 of FIG. 14 on the side wall 901, if necessary. The side sealing member 430 contacts the side-end portion of the developing roller 3 mounted to the housing 90 after assembling of the supply roller 4 is completed.

Figure 16:
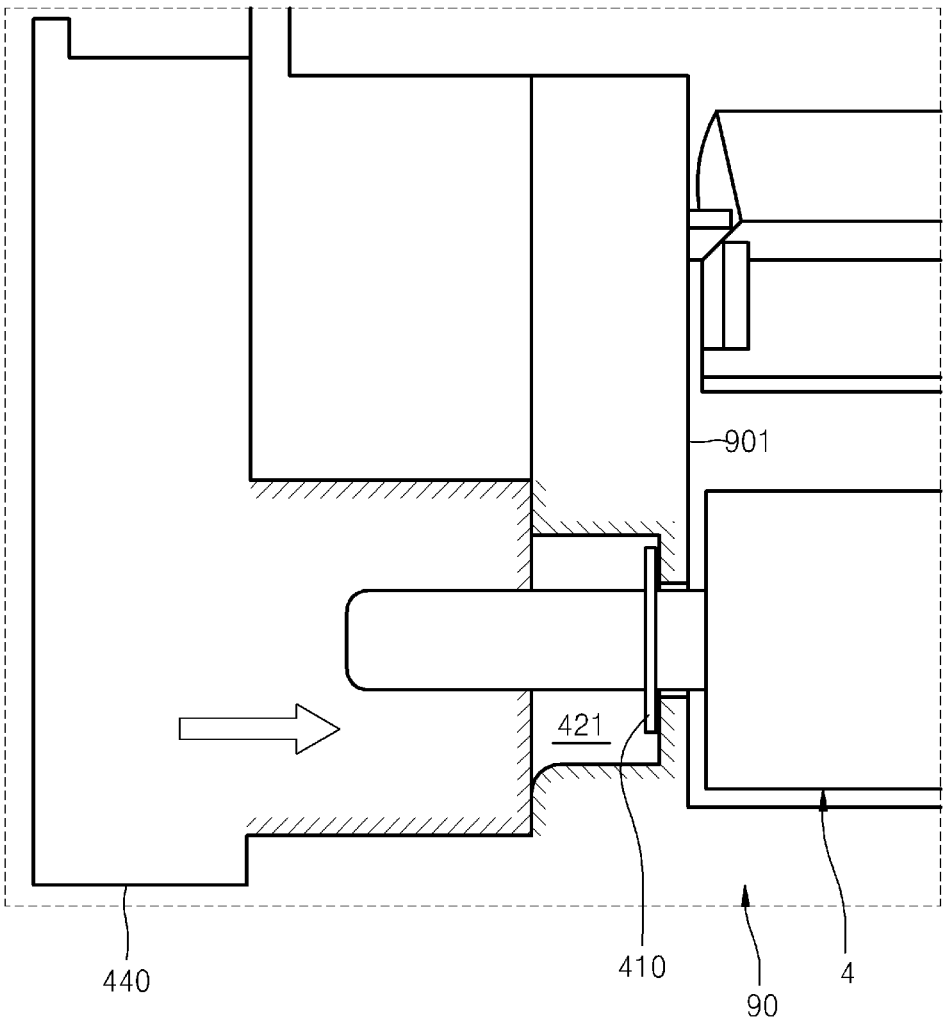
FIG. 16 is a diagram illustrating a mold forming a space for injecting a foam-type sealing material in a housing.

As illustrated in FIG. 16, a mold 440 is mounted to the housing 90. A liquid state foam-type sealing material is injected into a space 421 defined by the mold 440 and the side wall 901 of the housing 90. As the volume of the foam-type sealing material increases due to the foaming of the foam-type sealing material, the sealing washer 410 is pushed and adheres to the side wall 901. The foam-type sealing material is blocked by the sealing washer 410 and thus does not flow into the housing 90 over the side wall 901. The mold 440 supports the rotation shaft 401 of the supply roller 4 and may function as a jig that determines an installation location of the supply roller 4.

Figure 17:
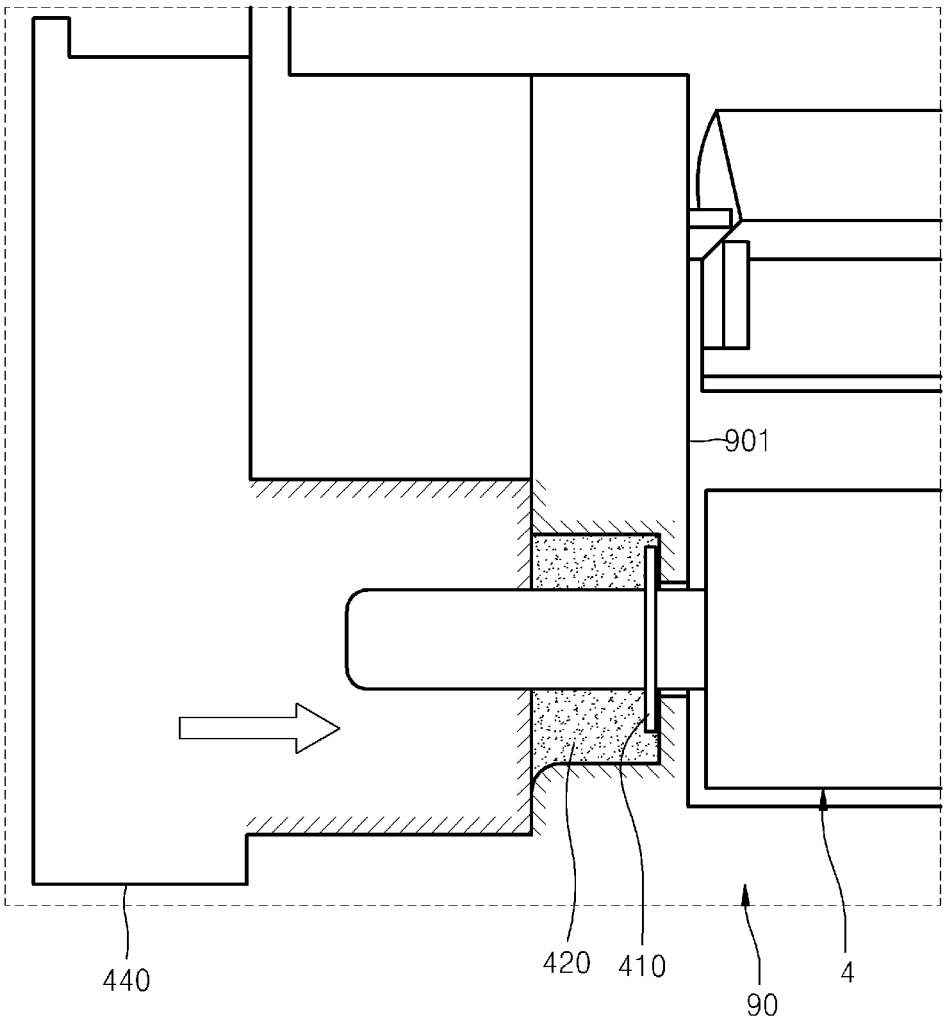
FIG. 17 is a diagram illustrating a sealing member formed by injecting a foam-type sealing material in a mold.

As the foam-type sealing material hardens, the space 421 is filled with the hardened sealing material and thus the sealing member 420 is formed as illustrated in FIG. 17. After forming of the sealing member 420 is completed, the mold 440 is removed. As described above, the sealing member 420 is located at the outside 903 of the side wall 901 of the housing 90 and thus may block toner T contained in the housing 90 from leaking to the outside of the housing 90 through the insertion hole 902. The sealing member 420 is strongly connected to the housing 90. Thus, when a rotation force is transmitted to the supply roller 4, the sealing member 420 is not rotated and only the supply roller 4 is rotated.

Figure 18:
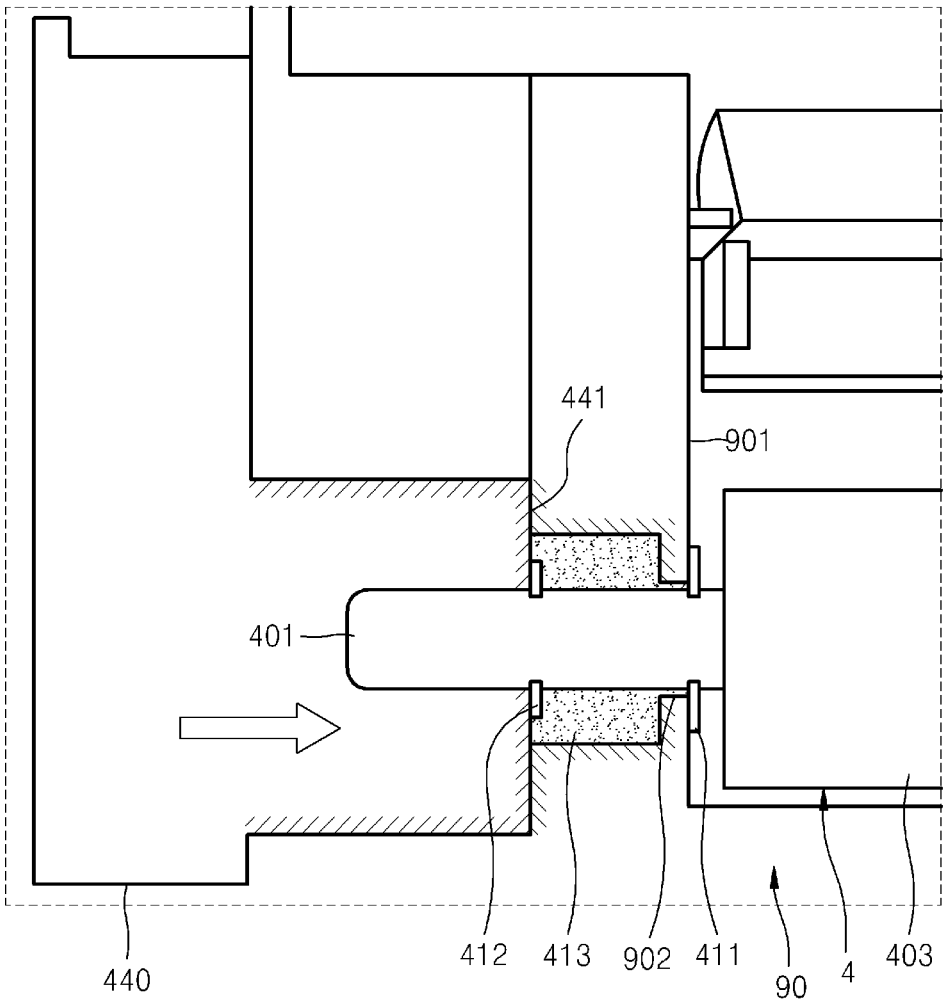
FIG. 18 is a general sealing structure including two sealing washers mounted on an end of a supply roller

In contrast, as illustrated in FIG. 18, two sealing washers 411 and 412 may be combined with the rotation shaft 401 of the supply roller 4 and a foam-type sealing material may be injected between the sealing washers 411 and 412, thereby forming a sealing member 413. That is, the sealing washer 411 is disposed inside the side wall 901, or on a side of the side wall 901 opposite the sealing member 413, and the sealing washer 412 is disposed outside the side wall 901, or on an opposite side of the side wall 901 as the sealing washer 411. The mold 440 is pressed against the side wall 901, and the washer 412 may be positioned next to the surface 441 of the mold 440. The foam-type sealing material flows into the gap between the insertion hole 902 prepared in the side wall 901 and the rotation shaft 401 of the supply roller 4. The sealing washer 411 blocks the foam-type sealing material from contaminating the body 402 of the supply roller 4. As the sealing washer 411 is disposed inside the side wall 901 and contacts the sealing member 413 only via the gap in the insertion hole 902, the sealing washer 411 does not securely contact the sealing member 413. Accordingly, when the supply roller 4 is rotated, the sealing washer 411 may rotate with the supply roller 4. Then, broken pieces of the sealing member 413 may be generated by friction between the foam-type sealing material flowing to the inside of the side wall 901 through the gap between the insertion hole 902 and the rotation shaft 401 and the sealing washer 411. The broken pieces of the sealing member 413 may contaminate the photoconductive drum 1, developing roller 3, supply roller 4, and the regulator 5 included in the housing 90 and cause a printing error or a defect of the developer 100. Also, the sealing washer 412 located outside may be pushed to the outside when the sealing member 413 is formed. As there is no structure supporting the sealing washer 412, a bonding strength between the shaped sealing member 413 and the sealing washer 412 is weak. Accordingly, when the supply roller 4 is rotated, the sealing washer 412 is rotated along with the supply roller 4 and the sealing member 413 may be damaged, thereby deteriorating sealing efficiency.

However, according to the sealing structure described with reference to FIGS. 12 through 17, the sealing washer 410 is disposed in the outside area 903 of the side wall 901 and thus the liquid state foam-type sealing material does not flow to a gap between the insertion hole 902 and the rotation shaft 401 of the supply roller 4.

Also, when the foam-type sealing material is foamed and shaped in the space 421, the sealing washer 410 receives a strong force between the foam-type sealing material and the side wall 901 and thus is strongly bonded with the formed sealing member 420. Accordingly, although the supply roller 4 is rotated, the sealing washer 410 is not rotated and thus broken pieces of the sealing member 420 due to friction between the sealing washer 410 and the sealing member 420 are not generated. In addition, although the supply roller 4 is rotated, the sealing member 420 is not damaged by the sealing washer 410 and thus the sealing effect of the sealing member 420 is maintained. Moreover, since only one sealing washer 410 is mounted to each end of the rotation shaft 401, the parts cost may be reduced compared with the general sealing structure illustrated in FIG. 18.

A single-color image forming apparatus including one developer 100 has been described above. However, the present invention is not limited thereto and four developers 100 containing toners for cyan C, magenta M, yellow Y, and black K may be included in a color image forming apparatus.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A developer, comprising:

a photoconductor to form an image thereon;

a cleaning member to remove waste toner from the photoconductor after the image is formed;

a waste toner container comprising a cleaning area in which the photoconductor and the cleaning member are located, and a waste toner storage area spaced apart from the cleaning area;

a rotation member located in the waste toner storage area and comprising an eccentricity unit;

a support unit of which at least a part thereof is inclined upward in a first direction from the cleaning area toward the waste toner storage area, the support unit extending from the cleaning area towards the waste toner storage area; and a waste toner transporting member located in the waste storage container and comprising:

a support protrusion that contacts the support unit by sliding, a plurality of horizontal ribs that are spaced apart from each other in the first direction and that extend lengthwise in a third direction perpendicular to the first direction, the third direction corresponding to a length of the photoconductor, and a plurality of spaces for transporting the waste toner between the plurality of horizontal ribs, where a width of each space is larger than a width of each adjacent space in the first direction from the cleaning area toward the waste toner storage area, wherein the waste toner transporting member transports the waste toner to the waste toner storage area from the cleaning area, and an end part of the waste toner transporting member is connected to the eccentricity unit and moves back and forth in the first direction and a second direction, respectively, and upward and downward due to a rotation of the rotation member.

2. A developer, comprising:

a photoconductor to form an image thereon;

a cleaning member to remove waste toner from the photoconductor after the image is formed;

a waste toner container comprising a cleaning area in which the photoconductor and the cleaning member are located, and a waste toner storage area spaced apart from the cleaning area;

a rotation member located in the waste toner storage area and comprising an eccentricity unit;

a support unit of which at least a part thereof is inclined upward in a direction from the cleaning area toward the waste toner storage area, the support unit extending from the cleaning area towards the waste toner storage area; and a waste toner transporting member located in the waste storage container and comprising a support protrusion that contracts the support unit by sliding, a plurality of horizontal ribs that are spaced apart from each other in the first direction and that extend lengthwise in a third direction perpendicular to the first direction, the third direction corresponding to a length of photoconductor, and a plurality of spaces for transporting the waste toner between the plurality of horizontal ribs, where a width of each space is larger than a width of each adjacent space in the first direction from the cleaning area toward the waste toner storage area, wherein the plurality of horizontal ribs have the same thickness in the first direction, the plurality of spaces have the same width in the first direction, and a stroke length of the waste toner transporting member in the first direction is at least larger than the sum of the thickness of a horizontal rib and the width of each one of the adjacent spaces, wherein the waste toner transporting member transports the waste toner to the waste toner storage area from the cleaning area, and an end part of the waste toner transporting member is connected to the eccentricity unit and moves back and forth in the direction and second direction, respectively, and upward and downward due to a rotation of the rotation member.

3. The developer of claim 1, wherein intervals between the plurality of horizontal ribs in the first direction are the same as each other and the thickness of the plurality of horizontal ribs in the first direction gradually increases from the cleaning area toward the waste toner storage area.

4. The developer of claim 3, wherein the stroke length of the waste toner transporting member in the first direction is at least larger than the intervals between the plurality of horizontal ribs in the first direction.

5. The developer of claim 1, wherein edges of the plurality of horizontal ribs facing the cleaning area include chamfered portions.

6. The developer of claim 1, further comprising an upper frame constituting an upper wall of the waste toner container, wherein the upper wall includes a recessed portion depressed downwardly toward the support unit.

7. The developer of claim 6, wherein both side walls of the recessed portion are inclined.

8. The developer of claim 6, wherein a width of the recessed portion increases in the first direction.

9. A developer, comprising:

a photoconductive drum to form an image thereon;

a cleaning member that removes waste toner from the photoconductive drum after image formation;

a waste toner container comprising a cleaning area in which the photoconductor and the cleaning member are located, and a waste toner storage area spaced apart from the cleaning area;

an upper frame constituting an upper wall of the waste toner container, wherein the upper wall includes a recessed portion that is depressed downwardly in a center portion of the upper frame, the center portion corresponding to center of the photoconductive drum in a lengthwise direction; and a waste toner transporting member located in the waste toner container to transport the waste toner to the waste toner storage area from the cleaning area, the waste toner transporting member including a plurality of horizontal ribs that are spaced apart from each other in the first direction and a plurality of spaces located between the plurality of ribs to transport the waste toner, where the widths of the spaces gradually decrease in the first direction from the cleaning area toward the waste toner storage area.

10. The developer of claim 9, wherein the waste toner transporting member moves back and forth in a first and second direction, respectively, and upward and downward.

11. The developer of claim 9, wherein edges of plurality of horizontal ribs facing the cleaning area include chamfered portions.

12. An electrophotographic image forming apparatus, comprising:

a developer to provide toner to a recording medium; and an exposing unit to provide a light to the developer, wherein the developer comprises:

a photoconductive drum to receive the light from the exposing unit;

a cleaning member to remove waste toner from the photoconductive drum a waste toner container comprising a cleaning area in which the photoconductor and the cleaning member are located, and a waste toner storage area spaced apart from the cleaning area; and an upper frame constituting an upper wall of the waste toner container, the upper wall including a recessed portion depressed downwardly in a center portion of the upper frame, the center portion corresponding to a center of the photoconductive drum in a lengthwise direction of the photoconductive drum, and side walls of the recessed portion in the lengthwise direction are inclined.

13. The apparatus of claim 12, wherein a width of the recessed portion increases in a first direction from the cleaning area to the waste toner storage area.

14. The apparatus of claim 12, further comprising a waste toner transporting member located in the waste toner container, wherein the waste toner transporting member transports the waste toner to the waste toner storage area from the cleaning area, and moves back and forth in the first direction and a second direction, respectively, and upward and downward, and the waste toner transporting member comprises a plurality of horizontal ribs that are spaced apart from each other in the first direction and a plurality of spaces between the plurality of ribs to transport the waste toner, the widths of the spaces gradually decreasing in the first direction.

15. A developer, comprising:

a photoconductive drum to form an image thereon;

a cleaning member to remove waste toner from the photoconductive drum;

a waste toner storage area to store the waste toner; and a waste toner transport member to move the waste toner from the cleaning member to the waste toner storage area, wherein the waste toner transport member moves back and forth in a first direction and a second direction, respectively, and up and down, to move the toner from the cleaning member to the waste toner storage area, the waste toner transport member including:

a plurality of ribs extending in a third direction perpendicular to the first direction and corresponding to a length-wise direction of the photoconductive drum, and a plurality of spaces located between the plurality of ribs, where each space has a width larger than each adjacent space in the first direction.

16. The developer according to claim 15, further comprising a rotation member, wherein a first end of the waste toner transport member is connected to the rotation member at a point offset from a rotation center of the rotation member to cause the waste toner transport member to move up, down, forward, and backward according to the rotation of the rotation member.

17. The developer according to claim 15, further comprising a support member extending between the cleaning member and the waste toner storage area to support toner as the toner moves from the cleaning member to the waste toner storage area.

18. The developer according to claim 17, wherein the waste toner transport member includes a protrusion on a lower surface thereof to contact the support member and to slide along the support member according to the back and forth movement of the waste toner transport member.

19. The developer according to claim 18, wherein the protrusion is located at a position of the waste toner transport member such that as an end of the waste toner transport member farthest from the cleaning member moves up, the end of the waste toner transport member closest to the cleaning member moves down to move closer to the cleaning member.

20. The developer according to claim 17, wherein the support member includes an inclined portion and an extended portion, the cleaning member being mounted to the inclined portion and the extended portion extending between an end of the inclined portion and the waste toner storage area.

21. The developer according to claim 16, wherein the developer further comprises a support member extending between the cleaning member and the waste toner storage area to support toner as the toner moves from the cleaning member to the waste toner storage area, the waste toner transport member includes a protrusion on a lower surface thereof to contact the support member and to slide along the support member according to the back and forth movement of the waste toner transport member, the support member includes an inclined portion and an extended portion, the cleaning member being mounted to the inclined portion and the extended portion extending between an end of the inclined portion and the waste toner storage area, and the protrusion of the waste toner transport member is located at a position on the waste toner transport member such that when the first end of the waste toner transport member connected to the rotation member moves in the second direction toward the cleaning member, the protrusion slides from the extended portion of the support member to the inclined portion of the support member.

22. The developer according to claim 21, wherein as the first end of the waste toner transport member moves from a backward-most rotation point in the first direction of the rotation member toward an upper-most rotation point, a second end of the waste toner transport member adjacent to the cleaning member moves downward closer to the cleaning member and in the second direction.

23. The developer according to claim 15, wherein a stroke length of the waste toner transport member is larger than a combined width of each rib respectively combined with each adjacent space.

24. The developer according to claim 15, wherein a side of each rib facing the second direction has a chamfered portion.

25. The developer according to claim 15, further comprising an upper wall located at least above the cleaning member and including a recessed portion at a location corresponding to a center of the photoconductive drum in the lengthwise direction of the photoconductive drum.

26. The developer according to claim 25, further comprising a support member extending between the cleaning member and the waste toner storage area to support toner as the toner moves from the cleaning member to the waste toner storage area, wherein the recessed portion is located above the support member.

27. The developer according to claim 25, wherein each side of the recessed portion in the lengthwise direction of the photoconductive drum is inclined with respect to an upper surface of the upper wall.

28. An image forming apparatus, comprising:

a developer to form an image on a recording medium; and an exposing unit to provide light to the developer to form the image, wherein the developer comprises:

a photoconductive drum to receive the light from the exposing unit to form an image;

a cleaning member to remove waste toner from the photoconductive drum;

a waste toner storage area to store the waste toner; and a waste toner transport member to move the waste toner from the cleaning member to the waste toner storage area, the waste toner transport member to move back and forth in a first direction and a second direction, respectively, and up and down, to move the toner from the cleaning member to the waste toner storage area, the waste toner transport member including:

a plurality of ribs extending in a third direction perpendicular to the first direction and corresponding to a length-wise direction of the photoconductive drum, and a plurality of spaces located between the plurality of ribs, where each space has a width larger than each adjacent space in the first direction.

* * * * *